US006560426B2

(12) United States Patent
Sakaizawa et al.

(10) Patent No.: US 6,560,426 B2
(45) Date of Patent: May 6, 2003

(54) IMAGE FORMING APPARATUS

(75) Inventors: Katsuhiro Sakaizawa, Numazu (JP); Satoshi Tsuruya, Mishima (JP); Jun Suzuki, Numazu (JP); Masaru Shimura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,377

(22) Filed: Sep. 7, 2001

(65) Prior Publication Data

US 2002/0048468 A1 Apr. 25, 2002

(30) Foreign Application Priority Data

Sep. 7, 2000 (JP) ..... 2000-271812

(51) Int. Cl.[7] ..... G03G 15/24
(52) U.S. Cl. ..... 399/150; 399/50; 399/89
(58) Field of Search ..... 361/225; 399/50, 399/89, 149, 150, 168, 174, 175, 176

(56) References Cited

U.S. PATENT DOCUMENTS 5,221,946 A 6/1993 Kohyama
6,035,162 A * 3/2000 Chigono ..... 399/175
6,128,456 A 10/2000 Chigono et al. ..... 399/176
6,266,495 B1 7/2001 Yuminamochi et al. ..... 399/66
6,282,391 B1 * 8/2001 Takeda ..... 399/175
6,285,848 B1 * 9/2001 Aita et al. ..... 399/175

FOREIGN PATENT DOCUMENTS

JP 4-20986 1/1992
JP 10-307455 11/1998
JP 11-149205 6/1999

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member; an electrostatic image forming unit for forming an electrostatic image on said image bearing member, the electrostatic image forming unit including a flexible charge member for electrically charging the image bearing member, the charge member forming a nip between the image bearing member and itself and is supplied with an oscillating voltage, wherein electroconductive particles are provided in the nip; and a developing unit for developing an electrostatic image formed on the image bearing member with a developer, the developing unit being capable of a residual developer on the image bearing member, wherein a frequency f (cycle/sec) of the oscillating voltage and a peripheral speed v (mm/sec) of the image bearing member satisfy $|f/v| \geqq 12$ (cycle/mm).

19 Claims, 9 Drawing Sheets

$$SF\ 1 = \frac{(MXLNG)^2}{AREA} \times \frac{\pi}{4} \times 100$$

$$SF\ 2 = \frac{(PERI)^2}{AREA} \times \frac{1}{4\pi} \times 100$$

IMAGE FORMING APPARATUS

FIELD OF THE INVENTION AND RELATED ART

The present invention relates to an image forming apparatus such as a laser beam printer, a copying machine, a facsimile machine or the like, with which an image is formed through an image formation process including a step of uniformly charging an image bearing member such as a dielectric member for electrostatic recording to a predetermined potential of a predetermined polarity.

More particularly, the present invention relates to an image forming apparatus which is of a contact charging and cleanerless type.

In the field of an image forming apparatus using an electrophotographic type, for example, a so-called cleanerless type image forming apparatus is known in which developing means also functions as cleaning means for removing residual toner still remaining on a surface of a photosensitive drum after toner image transfer onto a transfer material without using a particular cleaning means for such a purpose, by which the apparatus is downsized; the damage to the environmental health is suppressed because of the non-protection of waste toner; the lifetime of the photosensitive drum (image bearing member) is extended; the amount of the toner (developer) concerned for per page image formation is reduced.

(A) In such a cleanerless type image forming apparatus, an example of charging means is disclosed in Japanese Laid-open Patent Application 04-20986, for example. The charging means comprises a rotatable brush (elastic electroconductive member) as a contact charging member, which is contacted to the photosensitive drum to stir the untransferred toner remaining on the photosensitive drum to assist pattern destruction, and a DC voltage and an AC voltage are applied to uniformly charge the surface of photosensitive drum using this electric charge. Referring first to FIG. 12, there is schematically shown a peak-to-peak voltage of the AC voltage and a charging efficiency. In FIG. 12*a*, point L is a stable discharge point, and the electric discharge is stable in the range of the peak-to-peak voltage above point L, and the charged potential of the photosensitive drum is substantially the same as the DC voltage applied thereto (converged or saturated voltage). In view of the convergence or saturation of the charged potential in the range over the peak-to-peak voltage at the stabilization discharge point, the peak-to-peak voltage with which the charged potential exhibits the convergence is called "charged potential convergence voltage".

With the charging means of such a type in which a DC component biased with an AC component is applied to the elastic electroconductive member, the peak-to-peak voltage applied thereto is larger than the charged potential convergence voltage L for the purpose of stabilizing the charging action.

(B) On the other hand, Japanese Laid-open Patent Application 10-307455 discloses a simultaneous development and cleaning type image forming apparatus which is also of a cleanerless type, in which charging means is a direct charging type which does not use the electric discharge. More particularly, electroconductive charging-promotion particles are provided in the contact portion between the photosensitive drum and the contact charging member, and only a DC voltage is applied, by which a surface potential on the photosensitive drum is substantially the same as the DC voltage applied to the contact charging member. This system does not positively use the direct discharge phenomenon, and therefore, no ozone is produced. For the same reason, the deposition of electric discharge product onto the photosensitive drum can be suppressed, so that program of image flow under the high temperature and high humidity ambience can be avoided.

However, the following problem may arise in a cleanerless type image forming apparatus using (a) a rotatable brush (discharge function) or the charging means of the direct charging type.

With case (A), the toner is accumulated in the rotatable brush (contact charging member) with repetition of image forming operations with the result of improper charging.

The reason is as follows. The regular charging polarity of the toner (developer) is assumed as being negative, here. At that time when the untransferred toner passes through the transferring means, the toner particles are mixture of the toner particles charged to the positive polarity and the toner particles charged to the negative polarity. The amount of the toner particles charged to the positive polarity may be larger than the amount of the toner particles charged to the negative polarity.

The unstransferred toner contains so-called reversely charged toner particles, which are charged to the polarity (positive polarity toner) opposite to the regular polarity. These toner particles are attracted to the rotatable brush because of the electric field between the rotatable brush and the photosensitive drum.

The untransferred toner deposited on the rotatable brush enters the discharge region where the rotatable brush is opposed to the photosensitive drum, by the rotation of the rotatable brush.

In the discharge region, the electric discharge takes place with the results of production of positive charge and negative charge. The negative charge is attracted to the photosensitive drum to contribute to charging of the surface of the photosensitive drum. The simultaneously produced positive charge is attracted to the rotatable brush. At this time, the untransferred toner particles are deposited on the surface of the rotatable brush, and the untransferred toner particles are further electrically charged to the positive polarity.

Even if the untransferred toner charge to the positive polarity passes through the contact portion between the rotatable brush and the photosensitive drum and through the discharge region downstream of the contact portion with respect to the rotational direction, they are attracted toward the rotatable brush side due to the electric field formed between the rotatable brush and the photosensitive drum, and therefore, they are kept deposited on the charge member.

By repeating the foregoing operation, the toner deposited on the rotatable brush is charging strongly to the positive polarity. In addition, additional untransferred toner is accumulated even to such an extent that the charging member becomes unable to charge the photosensitive drum to the regular surface potential, with the result of improper charging.

When the AC voltage is sufficiently large, the discharge stably takes place, and the amount of electric discharge is large, and therefore, electric discharge product is deposited on the photosensitive drum. The electric discharge product thus deposited on the photosensitive drum exhibits low resistance under a high temperature and high humidity ambience, and therefore, image defect such as image flow tends to occur.

This is not limited to the rotatable brush, the above-described image defect results even in the case of the charging means using a contact charging member which relies on discharge function, for the same reasons.

When use is made of the charging means of the direct charging type as in case (B), the amount of the untransferred toner deposited on the charging means increases with the increase of the number of processings with a result of contamination of the charging means, and therefore improper charging and the image defect arise.

The reason is that in the case of the direct charging type charging means, the DC voltage applied to the charging means and the charged potential of the surface of the photosensitive drum are substantially the same, and therefore, the untransferred toner deposited on the charging means is not electrostatically delivered out of the charging means. The image defect is remarkable when a peripheral speed difference is provided between the photosensitive drum and the charging means so as to positively remove the untransferred toner from the photosensitive drum.

Japanese Laid-open Patent Application 11-149205 discloses that AC bias is superimposed to the DC bias during the non-image-formation period so as to deliver the toner from the charging means to the surface of the photosensitive drum.

However, when the AC bias (having a peak-to-peak voltage 200V, a frequency and a rectangular wave shape) is incorporated in an image forming apparatus using a non-magnetic toner, the untransferred toner delivering power is not enough with the result that so-called drum ghost image (image deterioration as a result of influence of an image hysteresis) with the increase of the number of prints. It is difficult to clean the charging means.

It to be possible to raise the peak-to-peak voltage simultaneously with the application of the AC bias also during the image formation, in order to prevent the drum ghost image. However, if this is done, the following image defect results.

When a halftone image is formed, a discrete single dot is not correctly reproduced as a single dot, but is reproduced as scattered dots. Such an image defect occurs remarkably in a high light range, that is, reflection density is 0.5 or less as measured by (Macbeth 1200) reflection density meter.

SUMMARY OF THE INVENTION

Accordingly, it is a principal object of the present invention to provide an image forming apparatus in which contamination of a charge member is effectively prevented. It is another object of the present invention to provide an image forming apparatus in which non-uniformity in charging is avoided, and therefore, image defect can be avoided. It is a further object of the present invention to provide an image forming apparatus and which a production of a ghost image can be avoided.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(A) Image Forming Apparatus Example

Figure 1:
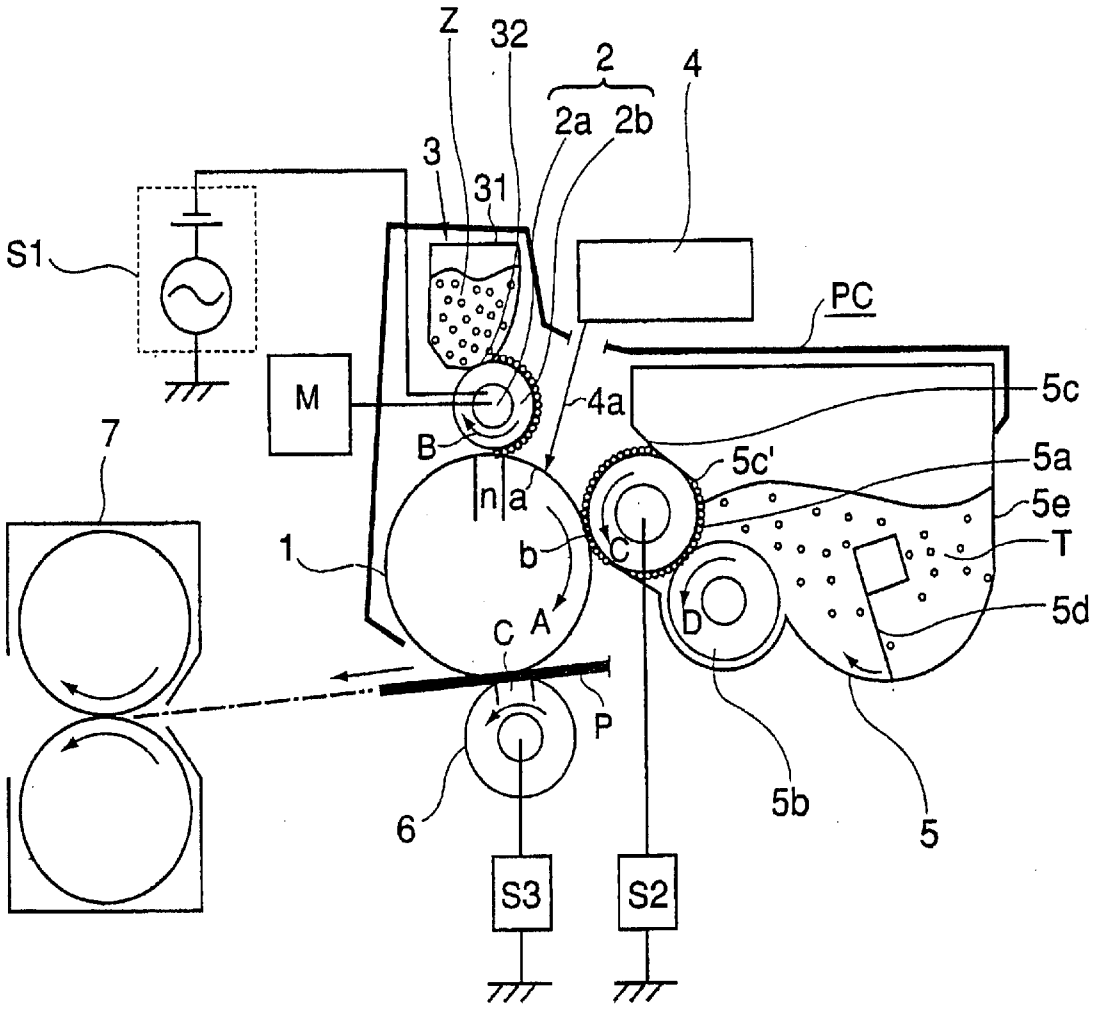
FIG. 1 is a rough sectional view of the image forming apparatus in the first embodiment of the present invention, for showing the general structure thereof.

FIG. 1 is a rough sectional view of an example of an image forming apparatus in accordance with the present invention, for showing the general structure thereof. The image forming apparatus in this embodiment is a laser printer (image forming apparatus), which employs a transfer type electrophotographic image forming method, a contact type charging method, a reversal type developing method, a cleanerless type cleaning method, and a process cartridge system.

In the printer in this embodiment, a contact type charging means, which is porous and flexible, at least across its peripheral surface, is placed in contact with an image bearing member, and a combination of DC voltage and AC voltage is applied to the contact type charging means. The magnitude of the peak-to-peak voltage of this AC voltage applied to the contact type charging means is no more than the voltage level to which the potential of the image bearing member converges. The frequency of the AC voltage is such that the number of oscillations of the AC voltage per unit of the moving distance (mm/sec) of the peripheral surface of the image bearing member becomes no less than 12 (cycles/sec). Further, cleaning process facilitating particles (electrically conductive particles), which are supplied from a cleaning process facilitating particle supplying means, are present in the interface between the contact type charging means and image bearing member. The contact type charging means strips the developer, which has remained on the image bearing member after image transfer; charges the peripheral surface of the image bearing member to a predetermined potential level; and expels the stripped developer in the downstream direction in terms of the rotational direction of the image bearing member. In other words, the contact type charging means functions as a charging/cleaning member, or a member which cleans while charging.

After being expelled from the contact type charging member, the developer is removed, to be reused, by a developing means placed in contact with the image bearing member, while the latent image on the image bearing member is developed by the developing means.

A referential code 1 designates the image bearing member. In this embodiment, the image bearing member 1 is in the form of a drum. It is 30 mm in diameter, and is based on negatively chargeable photoconductor (this image bearing member hereinafter will be referred to as photoconductive drum). The photoconductive drum 1 is rotationally driven in the clockwise direction indicated by an arrow mark A, at a constant peripheral velocity of 50 mm/sec (process speed).

(1) Charging Process

A referential code 2 designates an electrically conductive elastic roller (which hereinafter will be referred to as charging/cleaning roller) as a charging/cleaning member disposed in contact with the photoconductive drum 1 to generate a predetermined amount of contact pressure between the peripheral surfaces of the photoconductive drum 1 and elastic roller 2. A referential code n designates the charging nip between the photoconductive drum 1 and charging/cleaning roller 2, that is, where the photoconductive drum 1 and charging/cleaning roller 2 are kept pressed against each other. In order to efficiently charge the image bearing member using a contact type charging method, the contact area between the photoconductive drum 1 and charging/cleaning roller 2, in the charging nip n needs to be rendered as large as possible. In this embodiment, the charging/cleaning roller 2 is rendered porous across its peripheral surface to maximize the contact area between the photoconductive drum 1 and charging/cleaning roller 2.

Across the peripheral surface of the charging/cleaning roller 2, electrically conductive cleaning process facilitating particles z are borne. Further, in the charging nip n, or the compression nip formed between the photoconductive drum 1 and charging/cleaning roller 2, the cleaning process facilitating particles z, which are supplied as charging efficiency improving particles, from a cleaning process facilitating particles supplying means 3, are present.

The charging/cleaning roller 2 is rotationally driven in the direction indicated by an arrow mark B so that the rotational direction of the charging/cleaning roller 2 in the charging nip n becomes opposite (counter) to that of the photoconductive drum 1, and so that there is a predetermined amount of peripheral velocity difference between the peripheral surfaces of the charging/cleaning roller 2 and photoconductive drum 1. Designated by a referential code M is a power source for the charging/cleaning roller 2. To the charging/cleaning roller 2, a predetermined charge bias is applied from a charge bias application power source S1 while an image is formed by the printer. As a result, the peripheral surface of the rotating photoconductive drum 1 is charged to predetermined polarity and potential level; electrical charge is directly injected into the peripheral surface of the photoconductive drum 1 (charge injection, contact type charging method).

In this embodiment, the peripheral velocity of the charging/cleaning roller 2 is set to 75 mm/sec. Here, the peripheral velocity of the charging/cleaning roller 2 means the velocity at which a given point on the peripheral surface of the charging/cleaning roller 2, the distance of which from the axial line of the charging/cleaning roller 2 is equal to the average radius of the charging/cleaning roller 2, is moved by the rotation of the charging/cleaning roller 2 when nothing is in contact with the peripheral surface of the charging/cleaning roller 2. Defining the peripheral velocity difference between the charging/cleaning roller 2 and photoconductive drum 1 as being the difference in rotational velocity between the two, it is 150% in terms of the counter direction.

In this embodiment, a combination of DC and AC voltages is charged to the metallic core of the charging/cleaning roller 2 from the charge bias application power source S1. As a result, the peripheral surface of the photoconductive drum 1 is directly charged to a potential level (approximately −700 V), which is virtually the same as the potential level of the applied DC voltage. The specifications of the combination voltage are:

DC voltage: −700V

AC voltage:

peak-to-peak voltage: 1.0 kV frequency: 1.8 kHz waveform: sinusoidal

The magnitude and frequency of the AC voltage applied in combination with DC voltage significantly affects the manner in which the toner particles on the charging/cleaning roller 2, that is, the toner particles which have remained on the photoconductive drum 1 without being transferred (transfer residual toner particles), and adhered to the charging/cleaning roller 2, is expelled. Therefore, they will be described later in detail.

On the other hand, in this embodiment, the cleaning process facilitating particles z are supplied to the charging/cleaning roller 2 by the cleaning process facilitating particle supplying means 3. This cleaning process facilitating particle supplying means 3 comprises a container 31, in which the cleaning process facilitating particles z are held, and a regulating blade 32. The regulating blade 32 is placed in contact with the peripheral surface of the charging/cleaning roller 2 in a manner to retain a certain amount of the cleaning process facilitating particles z between the peripheral surface of the charging/cleaning roller 2 and regulating blade 32 so that the cleaning process facilitating particles z are coated on the charging/cleaning roller 2 by the regulating blade 32.

In this embodiment, zinc oxide particles, which are approximately 1 $\mu$m in average particle diameter, and have a specific resistivity of approximately $10^6$ ohm.cm, are employed as the cleaning process facilitating particles z.

(2) Exposing Process

A referential code 4 designates a laser beam scanner (exposing apparatus), as a data writing means, comprising a laser diode, a polygon mirror, and the like.

This laser beam scanner 4 outputs a laser beam 4*a*, the intensity of which is modulated with sequential digital electrical image signals representing the image data of an intended image. The uniformly charged peripheral surface of the rotating photoconductive drum 1 is exposed to the laser beam 4*a* which is being moved in a manner to scan the peripheral surface of the photoconductive drum 1, in the exposing station a. As a result, an electrostatic latent image, which reflects the image data of the intended image, is formed on the rotating photoconductive drum 1 by the laser beam 4*a* which is being moved in the scanning manner.

(3) Developing Process

Designated by a referential code 5 is a developing device, which is a reversal type developing device and uses non-magnetic single component toner T (negative toner) as developer. This developing device 5 in this embodiment is a contact type developing means, that is, a developing means, the developer bearing member of which makes contact with the photoconductive drum 1. It comprises: a toner container 5*e* in which toner is held; a development roller 5*a* as a developer bearing member, which is placed in contact with the photoconductive drum 1, and develops the electrostatic latent image, in the development station b, while being rotated in the counterclockwise direction indicated by an arrow mark D; a supply roller 5*b* as a toner supplying means for supplying the development roller 5*a* with toner T by rotating in the counterclockwise direction indicated by an arrow mark D; a development blade 5*c* as a toner regulating means for regulating the amount by which the toner T is coated on the development roller 5*a*, as well as the amount of the charge given to the toner T; a stirring member 5*d* for supplying the supply roller 5*b* with the toner T while stirring the toner within the toner container 5*e*; and the like.

In this embodiment, the image forming apparatus is structured so that the developing process is carried out by placing the development roller 5*a* in contact with the photoconductive drum 1, which is a rigid member.

Therefore, the development roller 5*a* is desired to be elastic. For this reason, the development roller 5*a* is provided with an elastic layer, which is formed of silicone rubber. As for the material for the elastic layer, NBR rubber (nitrile rubber), butyl rubber, natural rubber, acrylic rubber, hydrin rubber, urethane rubber, or the like, which are ordinarily used, may be used in place of the silicon rubber. Normally, the above listed materials for the elastic layer are increased in the amount by which they are impregnated with oil, in order to reduce their hardness. When the development roller 5*a* is provided with only a single elastic layer, and negatively chargeable toner is employed, urethane rubber, silicone rubber, NBR rubber, or the like, is preferably employed, in consideration of the manner in which toner is charged. Incidentally, when positively chargeable toner is employed, fluorinated rubber or the like is preferably employed.

Further, when the peripheral surface of the elastic layer is coated with an additional layer in consideration of the manner in which toner is charged, polyamide resin, urethane resin, silicone resin, acrylic resin, fluorinated resin, a mixture of some of the preceding resins, or the like, is preferably used as the material for the additional layer.

As the development blade 5*c*, any of the known toner regulating members, the portion of which placed in contact with the development roller 5*a* is formed of metallic material, rubber, or resinous material, may be employed. In this embodiment, it is a piece of thin stainless plate (approximately 0.1 mm thick) which has been bent along a straight line approximately 2 mm from its contact edge so that the edge of the bent portion 5*c*' slightly bites into the development roller 5*a*.

The toner T is supplied by the stirring member 5*c*, while being stirred by the stirring member 5*c*, to the interface between the development roller 5*a*, which is rotating in the direction C, and the supply roller 5*b*, which is rotating in the direction D. In the interface, the toner T is coated on the peripheral surface of the development roller 5*a* as the development rollers 5*a* and supply roller 5*b* rub against each other. Then, the toner T on the development roller 5*a* is given a predetermined amount of electrical charge by the development blade 5*c* while being regulated in amount by the development blade 5*c*. As a result, a proper amount of toner is borne on the development roller 5*a*.

To the development roller 5*a*, a predetermined development bias is applied from the development bias application power source S2. In the interface between the development roller 5*a* and photoconductive drum 1, as the development bias is applied to the development roller 5*a*, the toner borne on the development roller 5*a* is adhered to the peripheral surface of the photoconductive drum 1, in a selective manner, that is, in the manner to reflect the pattern of the electrostatic latent image formed on the peripheral surface of the photoconductive drum 1. As a result, the electrostatic latent image is reversely developed into a toner image, or a visual image.

In this embodiment, the development bias is a DC voltage of −400 V.

(4) Transferring Process

A referential code 6 designates a transfer roller as a contact type transferring means, the electrical resistance of which is in the middle range. The transfer roller 6 is kept pressed upon the photoconductive drum 1 by a predetermined amount of pressure, forming a transfer nip c.

Into this transfer nip c, a transfer medium P as a recording medium is fed from an unshown sheet feeding station with a predetermined timing, while a predetermined transfer bias is applied to the transfer roller 6 from a transfer bias application power source S3. As a result, the toner image on the peripheral surface of the photoconductive drum 1 is continuously transferred onto the surface of the transfer medium P which is being fed into the transfer nip c.

The transfer roller 6 in this embodiment comprises a metallic core, and a layer of foamed material coated on the peripheral surface of the metallic core. The electrical resistance of the transfer roller 6 is $5\times10^8$ ohm. The toner image is transferred by applying a voltage of +2.0 kV to the metallic core.

During the transfer process, in the transfer nip c, the toner image on the peripheral surface of the photoconductive drum 1 aggressively transfers onto the transfer medium P by being pulled toward the transfer medium P due to the effect of the transfer bias. On the other hand, the cleaning process facilitating particles z on the peripheral surface of the photoconductive drum 1 are electrically conductive. Therefore, they do not aggressively transfer onto the transfer medium P; they virtually entirely remain held to the peripheral surface of the photoconductive drum 1. The presence of the cleaning process facilitating particles z on the peripheral surface of the photoconductive drum 1 is effective to improve the efficiency with which the toner image transfers from the photoconductive drum 1 to the transfer medium P.

(5) Fixing Process

Designated by a referential code 7 is a fixing apparatus which employs a thermal fixing method or the like. After the toner image on the peripheral surface of the photoconductive drum 1 is transferred onto the transfer medium P in the transfer nip c, the transfer medium P is conveyed to the fixing apparatus 7, and then is introduced into the fixing apparatus 7. In the fixing apparatus 7, the toner image is fixed to the transfer medium P.

Thereafter, the recording medium P is discharged as a print or a copy from the image forming apparatus.

(6) Cleanerless Cleaning Process

The toner particles and cleaning process facilitating particles z remaining on the peripheral surface of the photoconductive drum 1 after the image transfer are conveyed to the charging nip n between the photoconductive drum 1 and charging/cleaning roller 2 by the rotation of the photoconductive drum 1. In other words, the cleaning process facilitating particles z on the peripheral surface of the photoconductive drum 1 are supplied to the charging nip n, and in the charging nip n, the cleaning process facilitating particles z are adhered to the charging/cleaning roller 2. In other words, the photoconductive drum 1 is charged through a contact type charging process, while the cleaning process facilitating particles z are present in the charging nip n formed by the photoconductive drum 1 and charging/cleaning roller 2.

The image forming apparatus in this embodiment is not provided with a dedicated cleaner (cleaning apparatus) such as a cleaning blade. Thus, as the photoconductive drum 1 rotates, the transfer residual toner particles, that is, toner particles remaining on the peripheral surface f the photoconductive drum 1 after the toner image on the photoconductive drum 1 was transferred onto the transfer medium P, reach the development station b through the charging nip n. In the development station b, they are recovered by the developing device 5 at the same time as the latent image on the peripheral surface of the photoconductive drum 1 is developed by the developing device 5. The transfer residual toner particles recovered by the development device 5 are reused.

Figure 2:
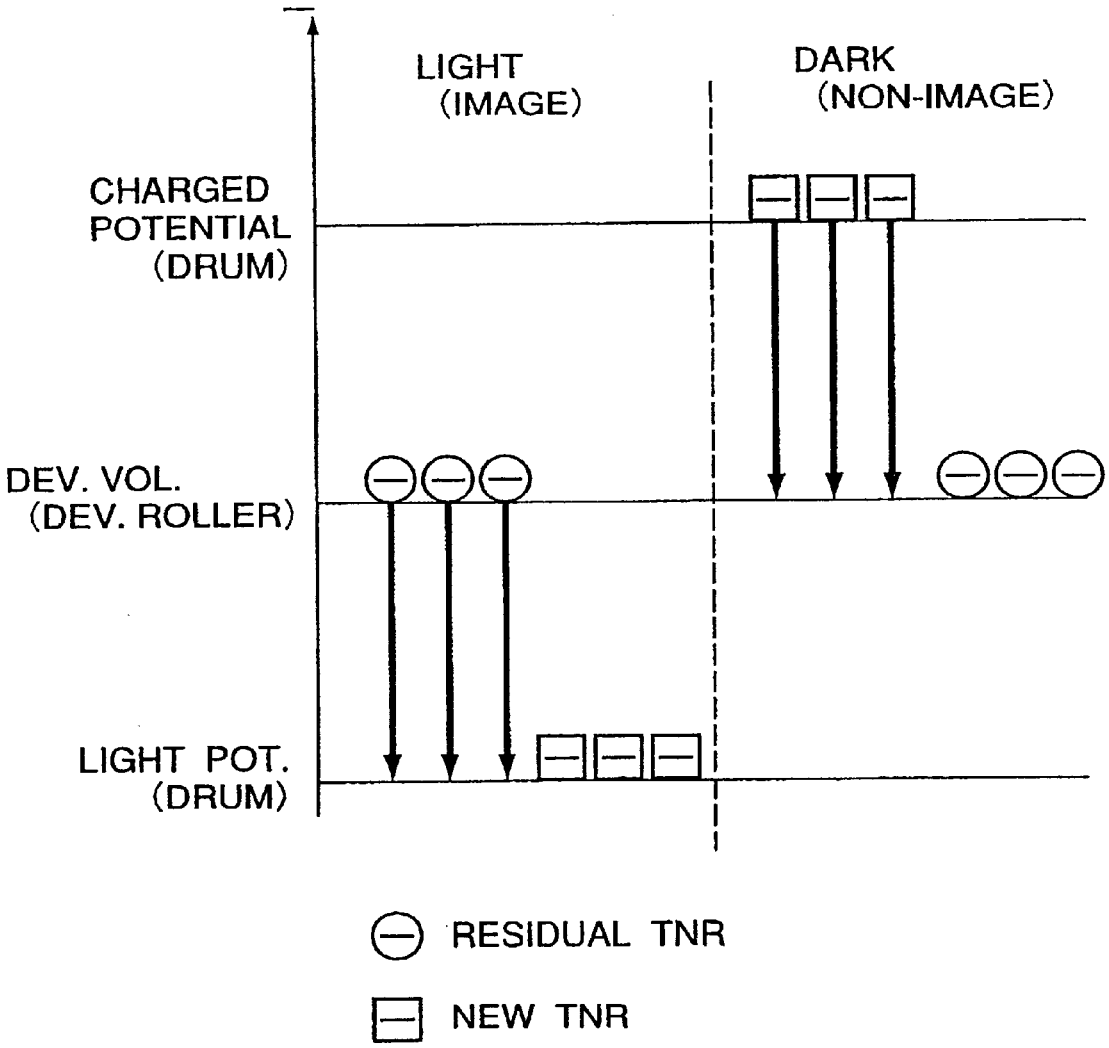
FIG. 2 is a drawing for describing a developing/cleaning method.

Next, referring to FIG. 2, the developing/cleaning process, that is, the process in which the transfer residual toner particles are recovered by the developing device 5 at the same time as the latent image is developed by the developing device 5, will be described. In the drawing, the symbol "□" represents a transfer residual toner particle present on the peripheral surface of the photoconductive drum 1, the symbol "○" represents a new toner particle which has just passed the development blade 5*b* and has been borne on the peripheral surface of the development roller 5*a*. The symbol "—" indicates toner polarity.

In the interface n (charging nip) between the photoconductive drum 1 and charging/cleaning roller 2, the transfer residual toner particles (toner particles which remained on the peripheral surface of the photoconductive drum 1 without being transferred onto the transfer medium P during the transfer process) become negatively charged toner particles by being rubbed by the photoconductive drum 1 and charging/cleaning roller 2 and also by being affected by the cleaning process facilitating particles z, which will be described later. As the photoconductive drum 1 is further rotated, the potential levels of exposed portions (image portions), that is, the portions of the peripheral surface of the photoconductive drum 1 exposed through the exposing process, become approximately −150 V. In the immediately following developing process, the transfer residual toner particles on the above described exposed portions remain on the photoconductive drum 1 as they are, while fresh toner particles borne on the development roller 5*a* are supplied to the aforementioned exposed portions by the potential level difference (approximately 250 V) between the development bias (−400 V) and the above described exposed portions, developing the exposed portions. At the same time, the negatively charged transfer residual toner particles on the unexposed portions (non-image portions) of the peripheral surface of the photoconductive drum 1 transfer onto the development roller 5*a* because of the different between the potential level (approximately −700 V) of the peripheral surface of the photoconductive drum 1 and the potential level (−400 V) of the development voltage applied to the development roller 5*a*. During this transferring process, the fresh toner particles on the development roller 5*a*, the positions of which correspond with those of the unexposed portions, remain as they are on the development roller 5*a*. In other words, the developing/cleaning process is carried out.

(B) Process Cartridge

The printer in this embodiment employs a process cartridge PC. A process cartridge PC is a cartridge which is removably mountable in the main assembly of the printer, and in which three processing devices, that is, the photoconductive drum 1, charging/cleaning roller 2, and developing device 5, are integrally disposed.

A process cartridge is a cartridge which is removably mountable in the main assembly of an image forming apparatus, and in which an image bearing member, and a least a charging means or developing means, are integrally disposed.

(C) Charging/Cleaning Roller 2

The charging/cleaning roller 2 in this embodiment comprises a metallic core 2*a*, and a layer 2*b* of foamed semiconductive material coated across the entirety of the peripheral surface of the metallic core 2*a*. The material for the foamed semiconductive layer 2*b* is a mixture of a resinous substance (for example, urethane), electrically conductive particles (for example, carbon black particles), sulfurizing agent, foaming agent, and the like.

As for the material for the semiconductor layer 2*b* of the charging/cleaning roller 2, a foamed rubbery substance, for example, EPDM, NBR, silicone rubber, IR, or the like, in which electrically conductive substance, such as carbon black, metallic oxides, or the like, has been dispersed for electrical resistance adjustment, may be used in addition to the aforementioned resin (urethane or the like). Instead of employing a foamed material, a nonfoamed material may be employed. In such a case, only the peripheries of the charging/cleaning roller 2 in terms of its radius direction are foamed to make them porous. Further, instead of dispersing electrically conductive substance, an ion conductive substance may be employed for electrical resistance adjustment.

Making microscopically porous the semiconductive layer 2*b* of the charging/cleaning roller 2, at least on the peripheries of the semiconductive layer 2*b* of the charging/cleaning roller 2, increases the number of the opportunities for the peripheral surfaces of the charging/cleaning roller 2 and photoconductive drum 1 to make contact with each other. Further, it improves the state of the contact between the peripheral surfaces of the charging/cleaning roller 2 and photoconductive drum 1, since, as the transfer residual toner particles flow into the charging nip n, the empty pores in the peripheries of the semiconductive layer 2*b* capture the transfer residual toner particles, taking them away from the photoconductive drum 1.

The charging/cleaning roller 2 is rotated in such a direction that the peripheral surfaces of the charging/cleaning roller 2 and photoconductive drum 1 move in the opposing directions, in the charging nip n. Therefore, the transfer residual toner particles are stripped one time from the peripheral surface of the photoconductive drum 1, making it possible for the photoconductive drum 1 to be efficiently charged through the direct charging process, with the presence of virtually no transfer residual toner particles in the charging nip n formed by the charging/cleaning roller 2 and photoconductive drum 1. Further, stripping away the transfer residual toner particles after they have traveled from the transfer nip c to the charging nip n prevents the pattern of the image formed during the preceding rotation of the photoconductive drum 1, from appearing as a ghost in the currently formed image, in particular, when the currently formed image is a halftone image.

The semiconductive layer 2*b* of the charging/cleaning roller 2, which has been formed following the above described procedure, is polished as necessary to obtain the charging/cleaning roller 2 in this embodiment, that is, an electrically conductive elastic roller which is 12 mm in diameter and 200 mm in length.

On the other hand, the measured electrical resistance of the charging/cleaning roller 2 in this embodiment was 100 kΩ. More specifically, the electrical resistance of the charging/cleaning roller 2 was measured under the following conditions; the charging/cleaning roller 2 is pressed against an aluminum drum with a diameter of 30 mm so that a total load of 9.8 N (1 kgf) applies to the metallic core 2*a* of the charging/cleaning roller 2, and a voltage of 100 V is applied between the metallic core 2*a* and aluminum drum.

It is important that the charging/cleaning roller 2 functions as an electrode. That is, it is necessary that the charging/cleaning roller 2 is provided with a sufficient amount of elasticity for keeping the charging/cleaning roller 2 properly in contact with an object to be charged, and that the electrical resistance of the charging/cleaning roller 2 is low enough to charge an object in motion. On the other hand, the voltage leak which occurs if an object to be charged has areas defective in terms of voltage resistance, for example, a pinhole, must be prevented. When an object to be charged is an electrophotographic photoconductive member, the electrical resistance of the charging/cleaning roller 2 is desired to be within a range of $10^4$–$10^7$ Ω in order to properly charge the electrophotographic photoconductive member while preventing the voltage leak.

Regarding the hardness of the charging/cleaning roller 2, if it is too low, the charging/cleaning roller 2 is unstable in shape, failing to remain properly in contact with an object to be charged (photoconductive drum), whereas if it is too high, not only does the charging/cleaning roller 2 fail to form a satisfactory charging nip n against the object to be charged, but also fails to properly contact the peripheral surface of the object to be charged, in microscopic terms. Therefore, the hardness of the charging/cleaning roller 2 is preferred to be in a range of 25 degrees to 50 degrees.

(D) Toner T

Next, the toner T used in this embodiment will be described in detail.

The toner T is a mixture of toner particles and external additive particles.

Although the image forming apparatus in this embodiment is enabled to use conventional toner which can be produced by a conventional pulverization method, polymerization method, or the like, the toner which will be described next is preferable as the toner to be used with the image forming apparatus in this embodiment.

It is desired that a toner in accordance with the present invention is in a range of 100–150 in terms of the shape factor SF-1 measured by an image analyzer, and in a range of 100–140 in terms of the shape factor SF-2, more preferably, in a range of 100–140 in terms of the shape factor SF-1 and in a range of 100–120 in terms of the shape factor SF-2. Further, it is desired that the value of (SF-2)/(SF-1) is no more than 1.0 while satisfying the preceding conditions. When the above conditions are all met, not only will the toner T be the most preferable in terms of various toner properties, but also in terms of its relationship with the image forming apparatus in this embodiment.

Figure 3:
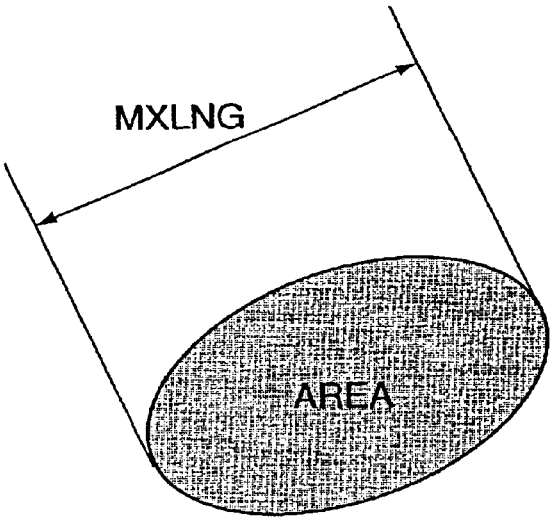
FIG. 3 is a drawing for describing the shape factor SF-1 for toner.
Figure 4:
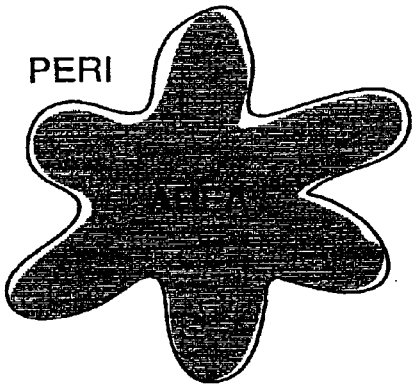
FIG. 4 is a drawing for describing the shape factor SF-2 for toner.

Regarding the aforementioned shape factors SF-1 and SF-2, 100 photographic toner particle images, which were taken at 500 magnification with the use of FE-SEM (S-800) (product of Hitachi, Ltd.,), are sampled at random, and their information is fed to an image analyzer Luzex 3 (product of NIKORE, Ltd.,) through an interface, and analyzed. Then, the values obtained using the following formulas are used as the shape factors SF-1 (FIG. 3) and SF-2 (FIG. 4) for the present invention:

$$SF\text{-}1=\{(MXLNG)^2/\mathrm{AREA}\}\times(\pi/4)\times 100$$

$$SF\text{-}2=\{(PERI)^2/\mathrm{AREA}\}\times(1/4\pi)\times 100$$

AREA: projected area of toner particle

MXLNG: absolute maximum length

PERI: circumference

The shape factor SF-2 for a toner shows the degree of the roundness of the toner particles of the toner, which ranges from being perfectly spherical to being indeterminate. The shape factor SF-2 for a toner shows the degree of the roughness of the surface of the toner particles in the toner. The greater the shape factor SF-2, the rougher the surface of the toner particles.

When the shape factor SF-1 for a toner exceeds 160, the toner is indeterminate in particle shape. Therefore, the range of the amount of the toner particle charge is broader, and also, the toner particles are likely to be shaved within the developing device. Consequently, it is likely that image density decreases, and/or a foggy image is formed.

In order to improve the efficiency with which an image formed of toner particles is transferred, it is preferred that the shape factor SF-2 for toner is in a range of 100–140, and the value of (SF-2)/(SF-1) is no more than 1.0.

If the shape factor SF-2 for a toner is no less than 140, and the value of (SF-2)/(SF-2) exceeds 1.0, the toner particles are not smooth on the surface; in other words, there is a large number of protrusions and recesses across the toner surface. Therefore, it is likely that the efficiency with which a toner image is transferred from the photoconductive drum 1 onto the transfer medium P or the like is unsatisfactorily low.

Further, in order to meticulously develop the microscopic dots of a latent image to produce an image of higher quality, it is desired that toner is no more than 10 μm in weight average particle diameter (preferably, in a range of 4 μm–8 μm), and no more than 30% in variation coefficient (A) of number-basis distribution. If a toner is no more than 4 μm in weight average particle diameter, the toner is low in transfer efficiency. Therefore, a relatively large amount of toner particles remain on the photoconductive drum 1 and/or intermediary transfer member, and further, the low transfer efficiency is likely to result in the formation of an image which is foggy, and/or inferior in terms of uniformity. Thus, a toner which is no more than 4 μm in weight average particle diameter is not preferable as a toner to be used with the present invention. If a toner is no less than 10 μm in weight average particle diameter, the toner particles are likely to fuse with the peripheral surface of the photoconductive drum 1, the intermediary transfer member, or the like members. This tendency is more conspicuous when the variation coefficient of number-basis distribution of a toner is no less than 35%.

The particle size distribution of a toner can be measured by various methods. In this embodiment, a Coulter counter is used.

More specifically, a Coulter counter TA-II (product of Coulter, Ltd.,) is used as a measuring apparatus, which is connected to an interface (Nikkaki, Ltd.,) which outputs number-basis distribution and volume-basis distribution, and a personal computer. As electrolyte, a 1% water solution of first class sodium chloride is prepared. For example, ISOTON II (product of Coulter Scientific Japan, Ltd.,) may be used.

Regarding the measuring method in this embodiments, 0.1–5 ml of surfactant (preferably, alkylbenzene-sulfonate) is added as dispersant to 100–150 ml of the above described electrolyte, and to this mixture, a sample of the substance to be measured is added. Then, the electrolyte in which the sample is suspended is stirred for approximately 2–3 minutes by an ultrasonic dispersing apparatus to evenly disperse the sample. Then, the number-basis particle size distribution of the toner particles which are in a range of 2–40 μm in particle size, is obtained with the use of the aforementioned Coulter counter TA-II with a 100 μm aperture. Then, the values concerning the present invention are obtained.

The variation coefficient A of the number-basis distribution for toner is calculated using the following formula:

$$\text{Variation Coefficient } A=[S/D1]\times 100.$$

In the formula, S stands for the standard deviation in the number-basis particle size distribution, and D1 stands for number-basis average particle diameter ($\mu$m).

Also regarding the toner particles used in this embodiment, it is preferable that the toner particle surface is coated or covered with external additive (inclusive of cleaning process facilitating particles, which will be described later) so that a desired amount of electrical charge is given to each toner particle.

In this context, it is desired that a toner is in a range of 5–99%, preferable, in a range of 10–99%, in terms of the ratio at which the toner particle surface is covered with the external additive.

Regarding the measurement of the ratio at which the toner particle surface is covered with the external additive, 100 toner particle images which were taken with the use of FE-SEM (S-800) (product of Hitachi, Ltd.,), are sampled at random, and their information is fed to an image analyzer Luzex 3 (product of NIKORE, Ltd.,) through an interface. Since the toner particle surface is different in lightness from the external additive portion, the thus obtained image information is binarized, and the area SG of the external additive portion, and area ST (inclusive of the area of the external additive portion) of the toner particle portion are separately obtained. Then, the ratio at which the toner particle surface is covered with the external additive is obtained using the following formula:

$$\text{External additive coated surface ratio } (\%)=(SG/ST)\times 100.$$

As for the external additive, it is possible to list a well-known external additive, for example, silica or the like.

Regarding the external additive, it is desired that 0.01–10 parts, preferably, 0.05–5 parts, in weight are used with 100 parts in weight of toner. The number of the external additives may be one, or two or more external additives may be used in combination. Further, it is preferred that the external additives has been rendered hydrophobic.

If the amount of the external additive is no more than 0.01 part in weight, single component developer is inferior in fluidity, which manifests as low transfer efficiency and low development efficiency. Therefore, an image which is irregular in density is formed, and/or so-called toner particle scatter occurs; toner particles scatter in the adjacencies of the image forming station. On the other hand, if the amount of the external additive is no less than 10 parts in weight, an excessive amount of the external additive adheres to the photoconductive drum 1 and/or development roller 5*a*, reducing the efficiency with which the photoconductive drum 1 is charged and/or resulting in the formation of an image with a disturbed appearance.

(E) Cleaning Process Facilitating Particles z

As for the material for the cleaning process facilitating particles z used in this embodiment, it is possible to use various electrically conductive particles: electrically conductive inorganic particles, for example, particles of metallic oxide (aluminum oxide, titanium oxide, tin oxide, zinc oxide, and the like); a mixture of inorganic and organic particles; the preceding particles which have given a surface treatment; and the like.

The electrical resistance of toner is calculated as specific resistance in the following manner. An approximately 0.5 g of powder sample is placed in a cylinder with a bottom area of 2.26 $cm^2$, and the specific resistance of the sample is measured while the sample is kept compacted with the application of 147N by the top and bottom electrodes and a voltage of 100 V is applied through the top and bottom electrodes. Then, the obtained values are normalized.

In order for electrical charge to be transferred or received, the specific resistance of the cleaning process facilitating particles z obtained using the above described method is desired to be no more than $10^{12}$ ohm.cm, preferably, no more than $10^{12}$ ohm.cm.

The average diameter of the cleaning process facilitating particles z is measured with the use of an optical or electron microscope. More specifically, no less than 100 cleaning process facilitating particles z are sampled to obtain the volumetric particle diameter distribution in terms of the maximum horizontal cord length, and the 50% average particle diameter in the thus obtained particle diameter distribution is employed as the average particle diameter of the cleaning process facilitating particles z.

In order for the cleaning process facilitating particles z to be used as micro-carriers, which will be described later, or spacer carriers, the average particle diameter of the cleaning process facilitating particles z, obtained using the above described method, is desired to be in a range of 0.1 $\mu$m–3.0 $\mu$m. If the average particle diameter of the cleaning process facilitating particles z is no more than 0.1 $\mu$m, it is likely that the cleaning process facilitating particles z easily adhere to toner particles with an ordinary size, and therefore, follow the movement of the toner particles, being therefore ineffective as spacer carriers. On the other hand, if the average particle diameter of the cleaning process facilitating particles z is no less than 3 $\mu$m, the cleaning process facilitating particles z tend to remain independent from the toner particles, failing to remain properly in contact with the toner particles, and therefore, it is more difficult for the cleaning process facilitating particles z to assist the toner particles to be negatively charged.

Not only are the cleaning process facilitating particles z in the form of primary particles, but also in the form of secondary particles, that is, an aggregate of primary facilitating particles z are in, as long as the cleaning process facilitating particles z properly function as cleaning process facilitating particles, the form of the cleaning process facilitating particles z is insignificant.

On the other hand, in consideration of the fact that the cleaning process facilitating particles z are partially transferred from the photoconductive drum 1 onto the recording medium P, it is desired that the cleaning process facilitating particles z are white or almost transparent, for if they are not white or almost transparent, they derogatorily affect the color reproduction by an image forming apparatus, in particular, a full-color image forming apparatus. Further, when the cleaning process facilitating particles z are used for enhancing the process for charging the photoconductive drum 1, they are also desired to be white or almost transparent, for it is important that the cleaning process facilitating particles z do not interfere with the process for exposing the photoconductive drum 1 to form a latent image. Further, the cleaning process facilitating particles z are desired to be nonmagnetic.

(F) Direct Charging (Charge Injection) and Expelling of Toner

In this embodiment, a charge injecting method, that is, a direct charging method, is employed as a charging method. In other words, the charging/cleaning roller 2 rendered porous across its peripheral surface, is disposed in a manner to cause its porous peripheral surface to rub against the peripheral surface of the photoconductive drum 1, with the provision of a peripheral velocity difference between the peripheral surfaces of the charging/cleaning roller 2 and photoconductive drum 1, to change the photoconductive drum 1 to a desired potential level. However, in the case of an image forming apparatus which employs a cleanerless cleaning system, that is, an image forming apparatus which does not have a cleaning means container, the transfer residual toner particles, that is, the toner particles which were not transferred from the photoconductive drum 1 onto the recording medium P and remained on the photoconductive drum 1, reach the charging/cleaning roller 2, that is, a directly charging member.

In the image forming apparatus in this embodiment, as the photoconductive drum 1 rotates, the transfer residual toner particles reach the charging nip n formed by the charging/cleaning roller 2 and photoconductive drum 1. As the transfer residual toner particles reach the upstream side of the charging nip n in terms of the rotational direction of the photoconductive drum 1, the transfer residual toner particles on the peripheral surface of the photoconductive drum 1 are scraped away from the peripheral surface of the photoconductive drum 1 by the friction between the walls of the empty pores of the charging/cleaning roller 2, which is being driven with the provision of peripheral velocity difference relative to the photoconductive drum 1, and the peripheral surface of the photoconductive drum 1. The transfer residual toner particles having been scraped off the peripheral surface of the photoconductive drum 1 reach the downstream side of the charging nip n as the charging/cleaning roller 2 rotates. At the same time in the charging nip n, electrical charge is injected into the peripheral surface of the photoconductive drum 1 from the peripheral surface of the charging/cleaning roller 2, charging the peripheral surface f the photoconductive drum 1 to a potential level virtually equal to the potential level of the DC voltage applied to the charging/cleaning roller 2.

To the charging/cleaning roller 2, AC voltage is being applied in addition to the DC voltage. Therefore, an alternating electrical field is formed between the charging/cleaning roller 2 and photoconductive drum 1.

Thus, as the charging/cleaning roller 2 rotates, the transfer residual toner having reached the downstream side of the charging nip n in terms of the rotational direction of the photoconductive drum 1, are made to shuttle between the peripheral surfaces of the photoconductive drum 1 and charging/cleaning roller 2, by the potential level difference generated between the peripheral surfaces of the photoconductive drum 1 and charging/cleaning roller 2. During this period, the photoconductive drum 1 is also rotating, and therefore, the transfer residual toner particles which had remained adhered to the peripheral surface of the photoconductive drum 1, are expelled from the peripheral surface of the charging/cleaning roller 2 as they are moved out of the effective range of the aforementioned alternating electrical field by the rotation of the photoconductive drum 1.

Also during this period, the cleaning process facilitating particles z borne on the peripheral surface of the charging/cleaning roller 2 function as micro-carriers and spacer carriers, improving the efficiency of the expelling of the transfer residual toner particles.

More specifically, while the transfer residual toner particles and cleaning process facilitating particles z are borne in mixture on the peripheral surface of the charging/cleaning roller 2, the cleaning process facilitating particles z function as micro-carriers. In other words, the cleaning process facilitating particles z charge the transfer residual toner particles to negative polarity by becoming charged to positive polarity. Further, the cleaning process facilitating particles z become interposed between the charging/cleaning roller 2 and transfer residual toner particles, functioning therefore as spacer carriers for making it easier for the toner particles to be expelled from the charging/cleaning roller 2 by the function of the alternating electric field, on the downstream side of the charging nip n in terms of the rotational direction of the photoconductive drum 1. Moreover, the expelled toner particles are all charged to negative polarity, ensuring that the expelled toner particles are recovered by the development roller 5*a* during the following process. The employment of the toner having the aforementioned shape factors, that is, toner which is almost spherical in particle shape, improves the aforementioned efficiency with which the toner particles are expelled, as well as the efficiency with which the expelled toner particles are recovered by the developing device.

The AC voltage applied to the charging/cleaning roller 2 is desired to be greater in potential gradient per unit of time. This is because it is thought that the greater the potential gradient, the greater the potential level difference between the peripheral surfaces of the charging/cleaning roller 2 and photoconductive drum 1. Further, efficiently expelling the toner particles allows the peripheral surface of the charging/cleaning roller 2 to contact, in the fully exposed state, the peripheral surface of the photoconductive drum 1, assuring that the photoconductive drum 1 is efficiently charged. Further, as the full exposure of the peripheral surface of the charging/cleaning roller 2 assures that the walls of the empty pores thoroughly rub the peripheral surface of the photoconductive drum 1, improving therefore the efficiency with which the transfer residual toner particles are recovered in the following process.

In this embodiment, a charge injecting method is employed. Thus, the charging process is carried out using AC voltage, the peak-to-peak voltage of which is no higher than a point L in FIG. 5. Therefore, the process for charging the photoconductive drum 1 does not primarily rely on electrical discharge. Therefore, toner polarity is not reversed; toner is not charged to positive polarity.

Further, even when some of the transfer residual toner particles have been positively charged and the others have been negatively charged, they all are recharged to negative polarity by the friction which occurs to the transfer residual toner particles when they are scraped off the peripheral surface of the photoconductive drum 1 in the charging nip n formed by the charging/cleaning roller 2 and photoconductive drum 1, and the friction which occurs scraped off the peripheral surface of the photoconductive drum 1 and having been borne on, and adhered to, the peripheral surface of the charging/cleaning roller 2 as they are rubbed as they re-enter the charging nip n, in addition to the aforementioned function of the cleaning process facilitating particles z as micro-carriers.

As regards the magnitude of the AC voltage applied in combination with DC voltage, it is desired to be not less than 500 V in peak-to-peak voltage, and no higher than a potential level to which the potential level of the peripheral surface of the photoconductive drum 1 converges. If the peak-to-peak voltage of the AC voltage is no more than 500 V, it is impossible to provide the potential level difference (between the peripheral surfaces of the charging/cleaning roller 2 and photoconductive drum 1) for expelling the toner particles by the AC voltage as described before, and therefore, it is difficult to pull the toner particles away from the peripheral surface of the charging/cleaning roller 2 to make the toner particles shuttle between the peripheral surfaces of the charging/cleaning roller 2 and photoconductive drum 1. On the other hand, if the peak-to-peak voltage is increased beyond the aforementioned potential level to which the potential level of the peripheral surface of the photoconductive drum converges, the amount of electrical discharge from the charging/cleaning roller 2 increases, and therefore, the potential level difference for causing the toner particles having adhered to the peripheral surface of the charging/cleaning roller 2, to be expelled therefrom, cannot be provided, making therefore it difficult to cause the toner particles to shuttle between the peripheral surfaces of the charging/cleaning roller 2 and photoconductive drum 1. As a result, the toner particles accumulate on the peripheral surface of the charging/cleaning roller 2. Further, as the amount of the electrical discharge from the charging/cleaning roller 2 increases, the toner particle polarity becomes positive.

Figure 12:
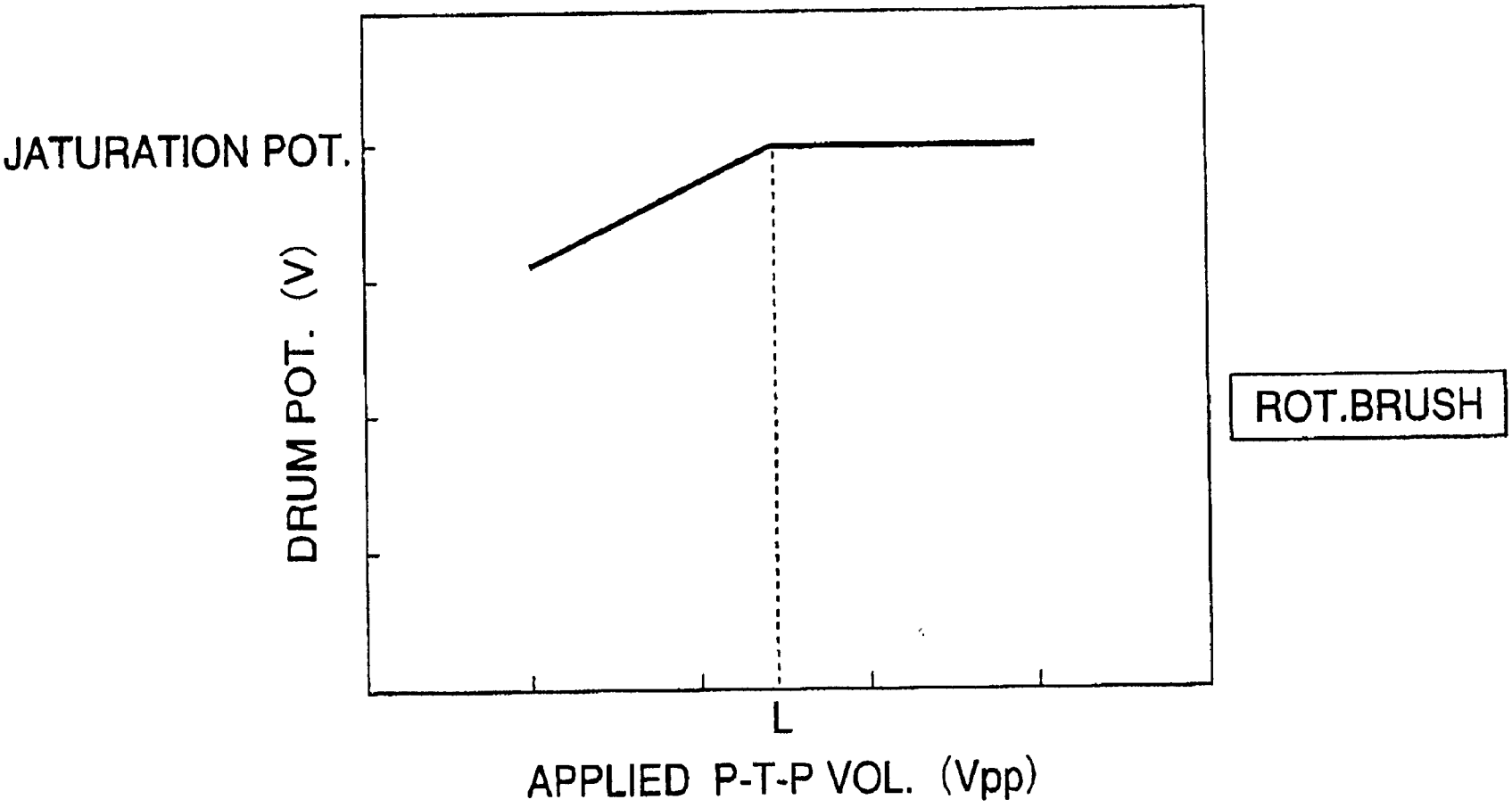
FIG. 12 is a graph for showing the charging efficiency of a conventional charging member, that is, the relationship between the drum potential level and peak-to-peak voltage, when the conventional charging member is used, and AC voltage is applied.

If the peak-to-peak voltage of the AC voltage applied to the charging/cleaning roller 2 is increased beyond the aforementioned voltage level to which the electrical potential of the photoconductive drum 1 converges, the photoconductive drum 1 is principally charged through electrical discharge. This means that the peak-to-peak voltage is greater than twice the electrical discharge starting voltage. In other words, when the peak-to-peak voltage is no less than twice the electrical discharge starting voltage, the AC discharge is stable, contradicting the operation of the image forming apparatus in this embodiment. Regarding the charging/cleaning roller 2 in this embodiment and the measurement of the potential level to which the potential level of the peripheral surface of the photoconductive drum converges, it is desired that the point L in FIG. 12 is measured while the charging/cleaning roller 2 is following the rotation of the photoconductive drum 1, with the charging/cleaning roller 2 placed in contact with the photoconductive drum 1 and without placing the cleaning process facilitating particles z in the charging nip n.

(G) "Elephant Skin"

As regards the frequency of the AC voltage, when the frequency of the AC voltage was in a range (5–500 Hz) as stated in Japanese Laid-open patent Application 11-149205, an image suffering from an image defect called "elephant skin" was formed as described regarding the example of a conventional image forming apparatus. Thus, this phenomenon was avidly studied. As a result, the following were discovered as the cause of "elephant skin".

Figure 8:
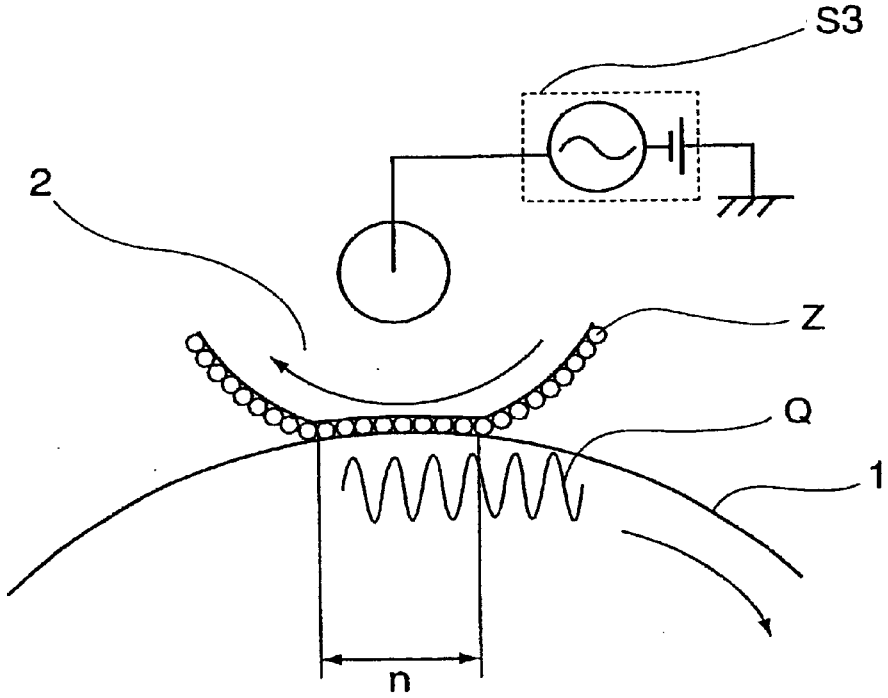
FIG. 8 is a rough drawing for showing the effects of the cleaning process facilitating particles in accordance with the present invention.

Referring to FIG. 8, a referential code n designates a contact nip between the charging/cleaning roller 2 and photoconductive drum 1. This contact nip n is formed with the interposition of the cleaning process facilitating particles z in the nip. In this embodiment, a method for directly injecting electrical charge is employed. Therefore, the surface potential level Q emulates the potential level of the charge bias S3.

As a given point on the photoconductive drum 1 departs from the content nip n due to the rotation of the photoconductive drum 1, electrical charge is not directly injected to the point any more. Therefore, the potential level at this point on the photoconductive drum 1 remains at the potential level Q to which the point has been charged in the contact nip n.

In reality, however, in order for electrical charge to be directly injected through the cleaning process facilitating particles z, it is necessary for the peripheral surface of the photoconductive drum 1 to directly contact the cleaning process facilitating particles z. It is thought that this contact occurs based on the law of probability. Therefore, the potential level of the give point becomes virtually the same as the potential level of the voltage being applied to the charging/cleaning roller 2, when this point comes in contact with the cleaning process facilitating particles z for the last time. Therefore, the peripheral surface of the photoconductive drum 1 is likely to be charged in a manner to result in a defective image, which is transferred to as "elephant skin" in the description of the example of a conventional image forming apparatus.

As the result of further serious studies of this phenomenon by the inventors of the present invention, it was discovered that the image defect called "elephant skin" is affected by the frequency of the bias S3 applied to the charging/cleaning roller 2. Thus, the frequency of the AC voltage applied to the charging/cleaning roller 2 is desired to be such that the number of the oscillations of the AC voltage per moving distance (mm/sec) of the peripheral surface of the photoconductive drum 1 per unit of time is no less than 12 (cycle/sec). Therefore, in this embodiment, the frequency of the AC voltage applied to the charging/cleaning roller 2 needs to be no less than 600 Hz, because the process speed is 50 mm/sec.

The frequency of the AC voltage is preferred to be such that the number of the oscillations of the AC voltage per moving distance (mm/sec) of the peripheral surface of the photoconductive drum 1 per unit of time is no less than 15 (cycles/sec). In other words, when the process speed is 50 mm/sec, the frequency of the AC voltage applied to the charging/cleaning roller 2 is preferred to be no less than 750 Hz.

As regards the upper limit of the frequency of the AC voltage per moving distance (mm/sec) of the peripheral surface of the photoconductive drum 1 per unit of time, no more than 20 kH is realistic, since it depends upon the performance of the power source for the AC voltage.

If the number of oscillations of the AC voltage applied to the charging/cleaning roller 2 per moving distance (mm/sec) of the peripheral surface of the photoconductive drum 1 per unit of time is no more than 12 (cycles/sec), the lower the frequency, the worse the "elephant skin".

As for the reason why the number of oscillations of the AC voltage applied to the charging/cleaning roller 2 per moving distance (mm/sec) of the peripheral surface of the photoconductive drum 1 per unit of time should be no less than 12 (cycles/sec), since a method for directly injecting electrical charge is employed as a charging method, a certain length of time is necessary for charge injection. Thus, if the frequency of the AC voltage is low, there is a lot of time for charge injection. Therefore, the surface potential of the photoconductive drum 1 emulates the potential level of the voltage applied to the given point on the peripheral surface of the photoconductive drum 1 for the last time in the nip n (value of the AC voltage being applied to the charging/cleaning roller 2 the moment the given point on the peripheral surface of the photoconductive drum 1 became separated from the peripheral surface of the charging/cleaning roller 2). Thus, if the number of oscillations of the AC voltage applied to the charging/cleaning roller 2 per moving distance of the peripheral surface of the photoconductive drum 1 per unit time is no more than 12 (cycles/sec), the peripheral surface of the photoconductive drum 1 is charged nonuniformly enough to be visually recognized as "elephant skin" in the resultant image. On the contrary, if the number of oscillations of the AC voltage applied to the charging/cleaning roller 2 per moving distance of the peripheral surface of the photoconductive drum 1 per unit of time is large (frequency is high), a sufficient amount of time is not available for charge injection. Therefore, electrical charge is gradually injected, and the potential level of the peripheral surface of the photoconductive drum 1 converges to the average value. Thus, the image defect called "elephant skin" or the like does not occur.

(H) Difference Between Charging Method in Accordance with the Present Invention and Conventional Charging Method At this time, the difference between the charging method employed in the image forming apparatus in this embodiment, and a conventional charging method, will be described.

Figure 5:
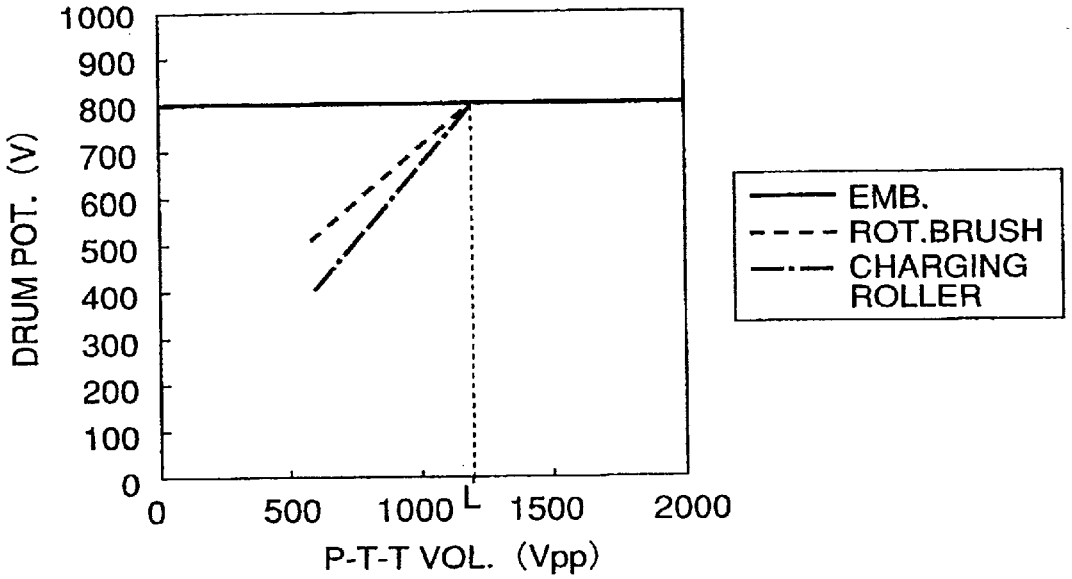
FIG. 5 is a graph for showing the relationship between the drum potential level and peak-to-peak voltage level of the AC voltage when a combination of DC voltage and AC voltage is applied as charge bias.
Figure 6:
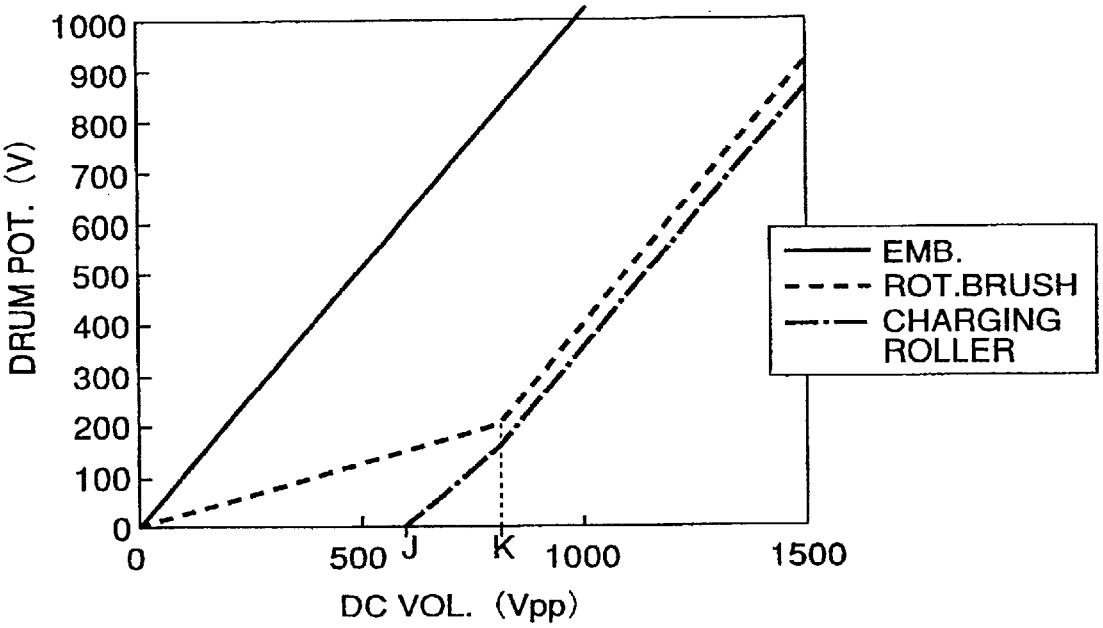
FIG. 6 is a graph for showing the relationship between the drum potential level and the DC voltage, when the DC voltage is the only voltage applied as charge bias.

FIG. 5 is a graph for showing the relationship between the drum potential level and the peak-to-peak voltage of the AC voltage applied to the charging/cleaning roller 2 in combination with DC voltage. FIG. 6 is a graph for showing the relationship between the drum potential level and the DC voltage applied to the charging/cleaning roller 2, when only DC voltage is applied to the charging/cleaning roller 2.

Referring to FIG. 5, to the charging/cleaning roller 2 for charging an object through electrical discharge (which hereinafter will be referred to as electrical discharge roller), an AC voltage which is higher in peak-to-peak voltage than a point L (1,2000 Vpp in this embodiment), which is the potential level to which the potential of the object to be charged converges, must be applied. If an AC voltage having a peak-to-peak voltage higher than the point L is applied, electrical discharge continuously occurs to the charging/cleaning roller 2, making it difficult to provide potential difference between the electrical discharge roller and the photoconductive drum 1, and therefore, making it difficult to cause the toner particles adhering to the electrical discharge roller, to be efficiently expelled onto the photoconductive drum 1. Further, the positive ions generated by the electrical discharge are attracted and adhered to the electrical discharge roller which is lower in potential level than the peripheral surface of the photoconductive drum 1. After being adhered to the electrical discharge roller, the toner particles are reversed in polarity (noncharged toner particles are charged to positive polarity).

As a result, on the electrical discharge roller, the transfer residual toner particles accumulate, making it impossible for the electrical discharge roller to charge the photoconductive drum 1 to the normal potential level; charge failure occurs. Further, even if the aforementioned toner particles reversed in polarity are stripped away from the electrical discharge roller by the mechanical friction, and expelled onto the photoconductive drum 1, they fail to be recovered by the developing device, creating a problem that a foggy image is outputted. As for the electrical discharge roller, its surface is rendered as smooth as possible to stabilize its charging performance. Therefore, it is low in the ability to scrape away the transfer residual toner particles. Thus, the following series of image formation processes, that is, charging, exposing, developing, and the like processes are carried out with the transfer residual toner particles remaining on the photoconductive drum 1. As a result, not only is the photoconductive drum 1 unevenly charged, but also a latent image which does not accurately reflect an intended image is formed; an image defect that the residual image from the preceding rotations of the photoconductive drum 1 appears as a so-called memory image (ghost image) in the image being currently formed sometimes occurs.

The above described phenomenon is also observed when the photoconductive drum 1 is charged with the use of a rotational brush. More specifically, when a rotational brush is used along with a charging method involving AC voltage, the transfer residual toner particles are taken into the brush. Therefore, as the cumulative length of the brush usage increases, the brush sometimes hardens, which is a problem.

Of the charging methods which are use electrical discharge, the DC based charging methods which apply only DC voltage require that the potential level of the DC voltage to be applied is higher than the points J and K in FIG. 6. Since a charging method employing only DC voltage is lower in the amount of electrical discharge (being therefore inefficient as a charging method) compared to a charging method employing AC voltage, it is low in the ability to charge to positive polarity, the toner particles adhering to the electrical discharge roller, generating therefore a smaller amount of positively charged toner particles compared to a charging method employing AC voltage. Yet, the positively charged toner particles continue to accumulate on the electrical discharge roller as they do when a charging method employing AC voltage is employed. As described before, as the toner particles accumulate on the electrical discharge roller, it becomes difficult for electrical charge to uniformly discharge across the discharging range. As a result, it becomes impossible for the peripheral surface of the photoconductive drum 1 to be charged to a desired potential level. As for a charging method employing a rotational brush, the transfer residual toner particles are likely to be taken into the brush, and therefore, the brush tends to harden.

On the other hand, if only DC voltage is applied to the charging/cleaning roller 2 in the image forming apparatus in this embodiment, no potential difference is provided on the downstream side, in terms of the rotational direction of the photoconductive drum 1, of the charging nip n formed by the charging/cleaning roller 2, and photoconductive drum 1. Therefore, no force is generated for expelling the toner particles adhering to the peripheral surface of the charging/cleaning roller 2. Thus, even in this case, the charging/cleaning roller 2 becomes contaminated, and the contamination reduces the charge injecting performance of the charging/cleaning roller 2, which results in the unsatisfactory charging of the photoconductive drum 1.

As regards a charge injecting method, that is, a direct charging method, when AC voltage is applied in combination with DC voltage, the surface potential of the photoconductive drum 1 emulates the potential of the applied voltage, becoming subtly uneven. However, it was discovered that this problem can be solved by employing a contact type developing method as a developing method.

Figure 7:
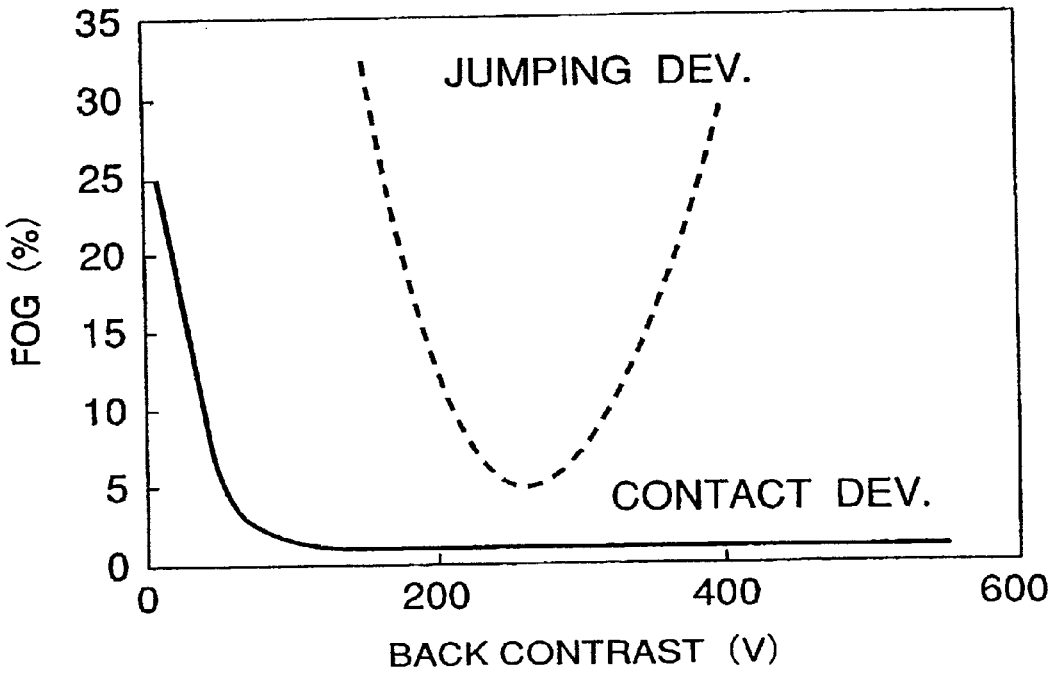
FIG. 7 is a graph for showing the difference in fogginess between noncontact development and contact development.

Although the charging means in this embodiment can be employed regardless of a developing method, it was discovered through the studies made by the inventors of the present invention that there occur differences in quality between the images outputted by a contact type developing method and a noncontact type developing method. The results are shown in FIG. 7, which shows the difference in fogginess between an image formed by a contact type developing method and an image formed by a noncontact type developing method. In a noncontact type developing method (jumping developing method), the range in which the fog caused by back contrast (absolute value of the difference between the surface potential level of the charged photoconductive drum 1 and the potential level of the development DC voltage) is tolerable, is narrow. This is due to the fact that in a jumping developing method, toner particles shuttle between the developer bearing member and photoconductive drum 1, and therefore, the subtle unevenness of the potential of the peripheral surface of the photoconductive drum 1 is reproduced (visualized by toner) by the toner particles. The unevenness of the surface potential of the photoconductive drum 1 translates into the unevenness in the back contrast. Thus, when the subtle unevenness in the potential is in the nonimage areas, it results in fogginess, degrading image quality.

In contrast type developing method, however, the effect of the back contrast upon fog generation is small, and further, the amount of the fog is extremely small. Therefore, even if the surface potential of the photoconductive drum 1 is slightly uneven, the amount of the fog does not increase; in other words, image quality is not seriously reduced by the fog. Further, regarding the recovery of the transfer residual toner particles having been expelled from the charging/cleaning roller 2, the transfer residual toner particles are scraped loose by the development roller, and therefore, they can be easily recovered.

It is evident from the above explanation that when a charging method in accordance with the present invention is employed, a contact type developing method is preferable as a developing method.

As described above, in the image forming apparatus in this embodiment, cleaning process facilitating particles z are placed in the contact nip n between the charging/cleaning roller 2 and photoconductive drum 1; a combination of DC voltage, and AC voltage the peak-to-peak voltage of which is no more than the potential level to which the surface potential of the photoconductive drum 1 converges, is applied to the charging/cleaning roller 2; and the frequency of the AC voltage is set so that the number of oscillations of the AC voltage per moving distance (mm/sec) of the peripheral surface of the image bearing member per unit of time becomes no less than 12 (cycles/sec). Therefore, it is possible for the image forming apparatus to output a high quality image, in particular, an image which does not suffer from an image defect called "elephant skin" for a long period.

Evaluation of Embodiment

In order to examine the performance of the image forming apparatus in this embodiment, the level of "elephant skin" in a highlighted image (only single point, which is in the middle of a 3×3 matrix, is highlighted) is evaluated, while varying the process speed and frequency of the AC voltage, to compare various settings in terms of charging performance.

Results of Evaluation

Table 1 shows the evaluation of the effects of the process speed and frequency of the AC voltage upon image quality.

TABLE 1

| FREQ. | | PROCESS SPEED (mm/sec) (Hz) | | | | |
|---|---|---|---|---|---|---|
| 50 | | 93 | | 133 | | |
| PERIODS | IMAGE | PERIODS | IMAGE | PERIODS | IMAGE | |
| 200 | 4 | N | 2.2 | N | 1.5 | N |
| 400 | 8 | N | 4.3 | N | 3.0 | N |
| 500 | 10 | F | 5.4 | N | 3.8 | N |
| 600 | 12 | G | 6.5 | N | 4.5 | N |
| 800 | 16 | G | 8.6 | N | 6.0 | N |
| 1000 | 20 | G | 10.8 | F | 7.5 | N |
| 1200 | 24 | G | 12.9 | G | 9.0 | N |
| 1400 | 28 | G | 15.1 | G | 10.5 | F |
| 1600 | 32 | G | 17.2 | G | 12.0 | G |

TABLE 1-continued

| FREQ. | | PROCESS SPEED (mm/sec) (Hz) | | | | |
|---|---|---|---|---|---|---|
| 50 | | 93 | | 133 | | |
| PERIODS | IMAGE | PERIODS | IMAGE | PERIODS | IMAGE | |
| 1800 | 36 | G | 19.4 | G | 13.5 | G |
| 2000 | 40 | G | 21.5 | G | 15.0 | G |
| 2500 | 50 | G | 26.9 | G | 18.8 | G |
| 3000 | 60 | G | 32.3 | G | 22.6 | G |
| 5000 | 100 | G | 53.8 | G | 37.6 | G |
| 8000 | 160 | G | 86.0 | G | 60.2 | G |

As for the nomenclature in the above table, G stands for no image defect (no charge defect); F, occurrence of "elephant skin" in some areas; and N stands for the occurrence of "elephant skin" across the entirety of the image.

The cleaning process facilitating particles were placed in the contact area between the charging/cleaning roller 2 and photoconductive drum 1, and a combination of DC voltage, and AC voltage, the peak-to-peak voltage in which was no more than the potential level to which the surface potential of the photoconductive drum 1 converges, was applied to the charging/cleaning roller 2. Further, the frequency of the AC voltage was set so that the number of oscillations of the AC voltage per moving distance (mm/sec) of the peripheral surface of an image bearing member per unit of time because no less than 12 (cycle/sec). As a result, the image forming apparatus could output, for a long period of time, a high quality image, in particular, an image which did not suffer from an image defect called "elephant skin".

Embodiment 2

The image forming apparatus in this embodiment is such an image forming apparatus that the cleaning process facilitating particles z, which are supplied from the cleaning enhancement supplying means 3 in the image forming apparatus in the first embodiment, are stored in the developing means by being evenly dispersed in the toner by a fixing device. Supplying the cleaning process facilitating particles from the developing means can simplify the structure for preventing the contamination of the charging member. In other words, the image forming apparatus in this embodiment is simpler in the structure for preventing the contamination of the charging member, and yet, is capable of removing the transfer residual toner particles at the same time and in the same place as the development process is carried out, to output, for a long period of time, a high quality image which does not suffer from the image defects such as fog resulting from the unsatisfactory charging of the image bearing member.

In addition, of the image formation components, the image bearing member and charging member which wear out relatively earlier than the other components, and the developing means inclusive of toner, are integrally disposed in a cartridge which is removably mountable in the main assembly of an image forming apparatus, to reduce the work required of a user involved in the various maintenance processes.

Figure 9:
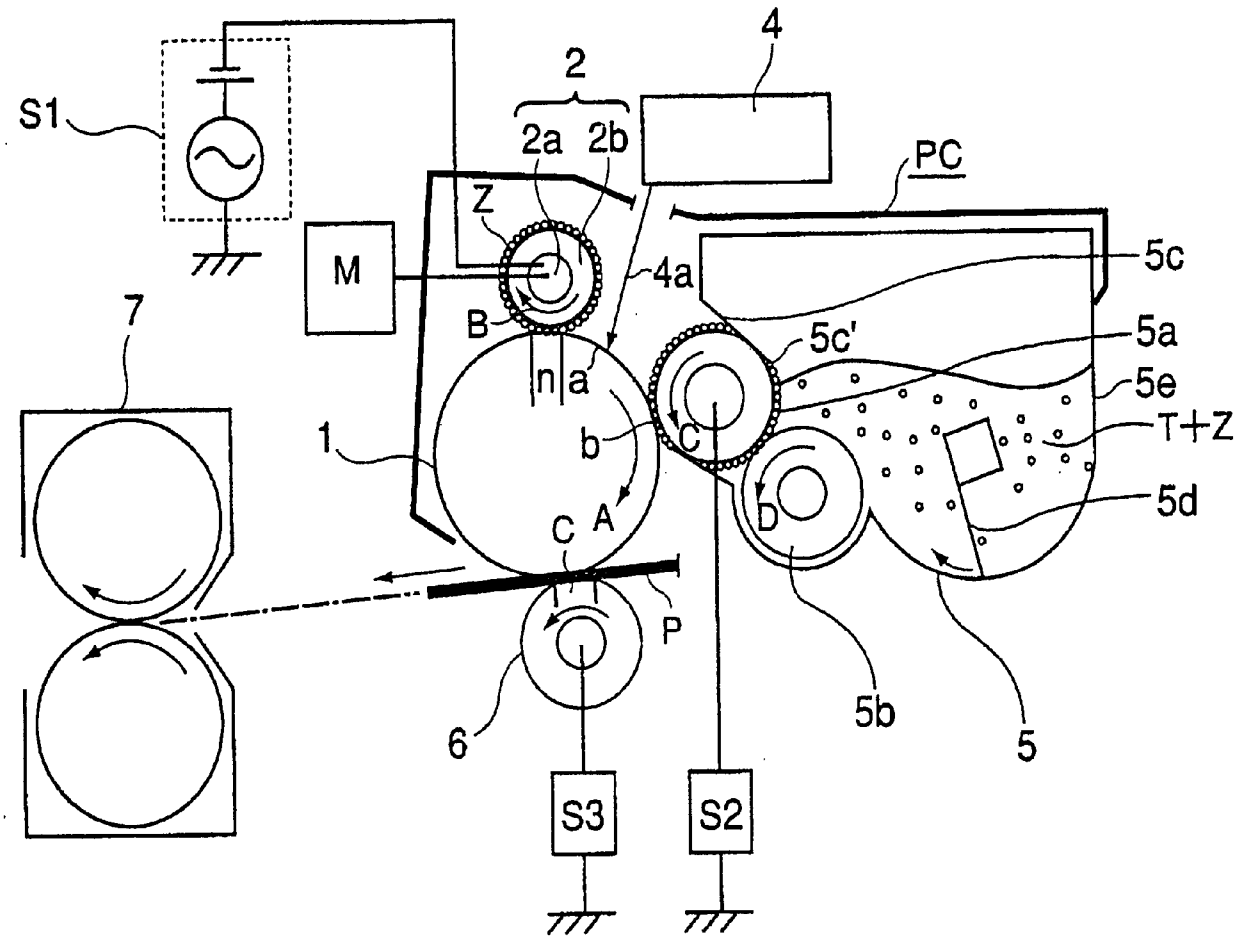
FIG. 9 is a rough sectional view of the image forming apparatus in the second embodiment of the present invention.

FIG. 9 is a rough sectional view of the image forming apparatus in this embodiment, for showing the general structure thereof. The image forming apparatus in this embodiment is such an image forming apparatus that the cleaning process facilitating particle supplying means 3 for supplying the charging/cleaning roller 2 with the cleaning process facilitating particles in the image forming apparatus (FIG. 1) in the first embodiment, has been eliminated, and that the cleaning process facilitating particles z are stored in the toner container 5*e* of the developing device 5 by being evenly dispersed, as an ingredient of the developer, in the toner T by a mixing device.

In this embodiment, zinc oxide particles which are $10^6$ ohm.cm in specific resistance and 1 $\mu$m in average particle diameter are used as the cleaning process facilitating particles z. The zinc oxide particles as the cleaning process facilitating particles z are added by 2.0 parts in weight to 100 parts in weight of the classified toner T used in the first embodiment, are evenly dispersed by a mixing device, and are stored in the toner container 5*e,* as an ingredient of the developer.

The charging/cleaning roller 2 is coated in advance with the cleaning process facilitating particles z.

As regards the charge bias applied to the charging/cleaning roller 2, a combination of:

DC voltage: −700 V

AC voltage:

0.8 kV in peak-to-peak voltage 1.8 kHz in frequency rectangular in waveform is applied. With the application of this charge bias, the peripheral surface of the photoconductive drum 1 is charged to a potential level (approximately −700 V) virtually equal to the applied DC voltage.

The structural arrangements of the image forming apparatus in this embodiment other than those described above are similar to those of the image forming apparatus in the first embodiment.

The cleaning process facilitating particles z dispersed in the toner T, as developer, in the developing device 5 adhere to the peripheral surface of the photoconductive drum 1, together with the toner particles, during the development of an electrostatic latent image on the peripheral surface of the photoconductive drum 1.

In the transfer nip c, the toner image on the peripheral surface of the photoconductive drum 1 aggressively transfers onto the transfer medium P by being attracted toward the transfer medium P due to the effect of the transfer bias. On the other hand, the cleaning process facilitating particles z do not aggressively transfer onto the transfer medium P, most of them remaining adhered to the peripheral surface of the photoconductive drum 1, because they are electrically conductive. The presence of these cleaning process facilitating particles z on the peripheral surface of the photoconductive drum 1 improves the efficiency with which the toner image transfers from the photoconductive drum 1 onto the transfer medium P, in addition to their primary function.

The transfer residual toner particles and the above described cleaning process facilitating particles z, which are remaining on the peripheral surface of the photoconductive drum 1, are conveyed by the rotation of the photoconductive drum 1, to the charging nip n between the photoconductive drum 1 and charging/cleaning roller 2, supplying the charging nip n with the cleaning process facilitating particles z. In the charging nip n, they adhere to the peripheral surface of the charging/cleaning roller 2, some of them entering the pores in the peripheral surface.

In other words, the photoconductive drum 1 is charged by the contact type charging method, with the presence of the cleaning process facilitating particles z in the charging nip n formed by the photoconductive drum 1 and charging/cleaning roller 2.

The image forming apparatus in this embodiment is of a cleanerless structure; it does not have a dedicated cleaner (cleaning apparatus) such as a cleaning blade or the like. Therefore, the transfer residual toner particles are recovered by the developing device 5, through the same process as that described with reference to FIG. 2, regarding the first embodiment, and are reused. During this recovery process, the cleaning process facilitating particles z which fell from the charging nip n and the charging/cleaning roller 2 are recovered by the developing device 5, in the developing station b, are mixed into the developer T, and are recycled.

Although the cleaning process facilitating particles z fall from the charging nip n and charging/cleaning roller 2 as an image forming operation continues, the cleaning process facilitating particles z contained in the developer T in the developing device 5 move onto the peripheral surface of the photoconductive drum 1, in the developing station b, and continuously reach the charging nip n through the transfer nip c, due to the movement of the peripheral surface of the photoconductive drum 1, supplying the charging nip n with the cleaning process facilitating particles z. Therefore, the cleaning process facilitating particles z are always present in the charging nip n, keeping the charging performance stable at a desirable level for a long period of time.

As described above, with the presence of the cleaning process facilitating particles z in the charging nip n, the friction between the photoconductive drum 1 and charging/cleaning roller 2 is reduced by the lubricating effect of the cleaning process facilitating particles z. Therefore, it is possible to drive the photoconductive drum 1 and charging/cleaning roller 2, without placing excessive load on the mutually rubbing components and a driving force source M, while keeping their peripheral surfaces in contact with each other and providing peripheral velocity difference between the photoconductive drum 1 and charging/cleaning roller 2.

Further, the provision of the peripheral velocity difference between the charging/cleaning roller 2 and photoconductive drum 1 drastically increases the probability that the cleaning process facilitating particles z make contact with the peripheral surface of the photoconductive drum 1, in the charging nip n between the charging/cleaning roller 2 and photoconductive drum 1, improving the state of the contact between the peripheral surfaces of the photoconductive drum 1 and charging/cleaning roller 2.

In other words, the cleaning process facilitating particles z present in the charging nip n between the charging/cleaning roller 2 and photoconductive drum 1 rub the peripheral surface of the photoconductive drum 1, leaving virtually no gap between the two surfaces. Therefore, electrical charge is directly injected with a higher degree of efficiency. Consequently, the photoconductive drum 1 is charged by the charging/cleaning roller 2 mainly through charge injection, that is, a direct charging process.

As described above, in the image forming apparatus in this embodiment, the cleaning process facilitating particles z are placed in the contact nip between the charging/cleaning roller 2 and photoconductive drum 1; the frequency of the AC voltage is set so that the number f of the oscillations of the AC component of the oscillating bias applied to the charging member satisfies the following formula:

$$|f/v| \geqq 12 \text{ (cycle/mm)}$$

v: peripheral velocity of an image bearing member (mm/sec)

Therefore, it is possible to suppress the phenomenon that as electrical charge is injected into the photoconductive drum 1 by the application of a combination of DC voltage and AC voltage, the peripheral surface of the photoconductive drum 1 becomes nonuniformly charged.

As is evident from the above description of the second embodiment of the present invention, the present invention makes it possible to prevent the fog resulting from the unsatisfactory charging of the photoconductive drum 1, for example, the nonuniform charging of the photoconductive drum 1, to continuously obtain high quality images.

Not only is the charging/cleaning roller 2 used as a charging member for charging the peripheral surface of the photoconductive drum 1 to a predetermined potential level by the application of a combination of DC voltage, and AC voltage, the peak-to-peak voltage of which is no less than 500 V, and no higher than the potential level to which the surface potential of the photoconductive drum 1 converges, to the charging/cleaning roller 2, but also it is made to function as a cleaning member for scraping away the toner particles remaining on the peripheral surface of the photoconductive drum 1 after the image transfer, and expelling them onto the downstream side of the charging nip n in terms of the rotational direction of the photoconductive drum 1, to prevent the contamination of the charging/cleaning roller 2. Therefore, it is possible to reliably obtain a high quality image, that is, an image which does not suffer from the image defects, such as fog, which result from the unsatisfactory charging of the photoconductive drum 1, for a long period of time.

Further, supplying the cleaning process facilitating particles z from the developing means makes it possible to simplify the structure of an image forming apparatus, making it possible to further reduce the image forming apparatus size as well as the cost, without reducing the effects of the cleaning process facilitating particles z.

Further, of the image formation components in the image forming apparatus in this embodiment, the photoconductive drum 1 and charging/cleaning roller 2 which wear out relatively earlier than the other components, and the developing means 5 inclusive of the developer T, are integrally disposed in a cartridge which is removably mountable in the main assembly of an image forming apparatus, creating a process cartridge PC, to reduce the work required of a user involved in the various maintenance operations, for example, the supplying of toner, exchange of the photoconductive drum 1 the service life of which has expired, and the like. Therefore, it is possible to continuously form images of desirable quality through a simple operation.

Incidentally, having the cleaning process facilitating particles z borne on the peripheral surface of the charging/cleaning roller 2 in advance makes it possible for the charging/cleaning member, that is, a direct type charging member, to charge the photoconductive drum 1 with higher efficiency as soon as a process cartridge is put to use for the first time.

In this embodiment, AC voltage having a rectangular waveform is applied. However, AC voltage is not restricted in terms of waveform. For example, AC voltage with a triangular waveform may be applied with the same results as those obtained with the AC voltage with the rectangular waveform, which is obvious.

Embodiment 3

Figure 10:
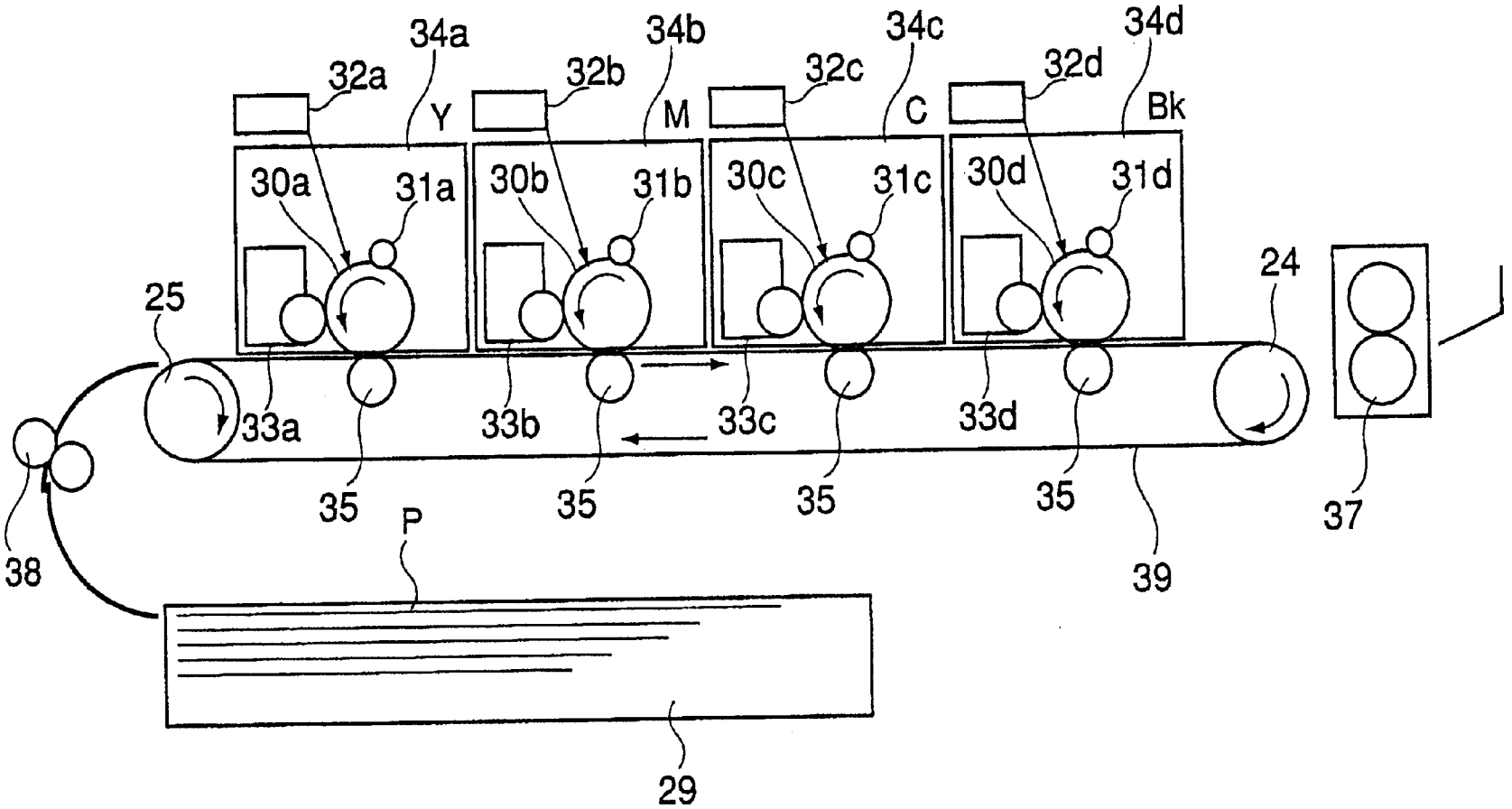
FIG. 10 is a rough sectional view of the image forming apparatus in the third embodiment of the present invention.

FIG. 10 is a rough sectional view of the image forming apparatus in this embodiment, for showing the general structure thereof. This image forming apparatus is a tandem type full-color image forming apparatus. It comprises: a plurality of image bearing members; a plurality of charging means for charging the plurality of image bearing members one for one; a plurality of developing means for forming a plurality of toner images different in color by developing, with the use of a plurality of toners different in color, a plurality of electrostatic latent images formed on the charged peripheral surfaces of the plurality of image bearing members, one for one; and a plurality of transferring means for sequentially transferring the plurality of toner images different in color, onto transfer medium. It is characterized in that at least one of the plurality of charging means is a contact type charging apparatus which charges the peripheral surface of the image bearing member with the use of an elastic charging member which forms a contact nip against the image bearing member; that the charging member is porous at least across its surface which contacts the image bearing member, and is driven in a manner to maintain a predetermined amount of velocity difference relative to the image bearing member; that a combination of AC and DC voltages is applied to the charging member at least during an image recording period; and that the frequency f (cycle/sec) of the AC voltage is set so that the following formula is satisfied:

$$|f/v| \geqq 12 \text{ (cycle/mm)}$$

v: peripheral velocity of an image bearing member (mm/sec), so that the phenomenon that as electrical charge is injected into the photoconductive drum 1 by the application of a combination of DC voltage and AC voltage, the peripheral surface of the photoconductive drum 1 becomes nonuniformly charged is suppressed.

In FIG. 10, referential codes Y, M, C, and Bk designate first to fourth image forming means which forms four images different in color. The four image forming means comprise: photoconductive drums 30*a*–30*d*, charging means 31*a*–31*d*, exposing means 32*a*–33*d*, and developing means 33*a*–33*d*, one for one. They are in the form of a process cartridge (34*a*–34*d*) comprising a cartridge, and a set of a photoconductive drums (30*a*–30*d*), a charging means (31*a*–31*d*), and a developing means (33*a*–33*d*), which is integrally disposed in the cartridge. The process cartridge simplifies the replacement of essential components, improving the efficiency with which the apparatus is maintained by a user.

The first to fourth image forming means Y–Bk form an image with the use of yellow, magenta, cyan, and black toners, correspondingly.

The developing means 33*a*–33*d* of the first to fourth image forming means Y–Bk, correspondingly, are identical in structure except that yellow, magenta, cyan, and black toners are contained in their developing devices, correspondingly.

Hereinafter, the image forming operation of this image forming operation will be described in detail.

In each of the first to fourth image forming means Y, M, C, and Bk, a beam of laser light modulated with the image data from a host such as a personal computer is projected by the exposing means (32*a*–32*d*) onto the peripheral surface of the photoconductive drum (30*a*–30*d*) having been uniformly charged by the charging means (31*a*–31*d*). As a result, four electrostatic latent images correspondent to yellow, magenta, cyan, and black colors are formed on the peripheral surfaces of the photoconductive drums 30*a*–30*d*, one for one. These latent images are reversely developed into toner images, or visual images, by the developing means 33*a*–33*d*, that is, four developing devices which contain yellow, magenta, cyan, and black toners, one for one, and are disposed in manner to oppose the photoconductive drums 30*a*–30*d*, one for one.

More specifically, first, a yellow toner image is formed on the photoconductive drum 30*a*, in the first (first color) image forming means Y. During the formation of this yellow toner image, a recording paper P as a transfer medium is fed into the image forming apparatus main assembly from a transfer medium holding device 29 such as a cassette, and is conveyed to a registration roller pair 38. The recording paper P is stopped once by the registration roller 38, and then, is released with a predetermined timing, onto an electrostatic conveying belt 39, which is suspended around a driver roller 24 and a follower roller 25, and to which the recording paper P is adhered by an unshown recording paper attracting roller, Then, the recording paper P is conveyed to a nip between the electrostatic conveying belt 39 and a transfer roller 35, in which the yellow toner image is transferred onto the recording paper P.

Next, magenta, cyan, and black toner images are sequentially transferred in layers onto the same recording paper P from the photoconductive drums 30*b*, 30*c* and 30*d*, in the second (second color), third (third color), and fourth (fourth color) image forming means M, C, and Bk, through the same processes as the process through which the yellow toner image has been formed. As a result, a full-color toner image is formed on the recording paper P. The full-color toner image on the recording paper P. The full-color toner image on the recording paper P is welded (permanently fixed) to the recording paper P by a fixing means 37 such as a fixing apparatus. Then, the recording paper P is discharged, facing upward, as a desired color print, into a delivery tray.

As regards each of the first to fourth image forming means Y, M, C, and Bk, each of the members constituting each of the process cartridges 34*a*–34*d*, each of the voltages applied to the charging members, and the like, which are employed in this embodiment, they are the same in structure or composition as those employed in the image formation mechanism in the first or second embodiment.

The employment of the direct charging method, which uses the contact type charging member described regarding the first or second embodiment, by a color image forming apparatus such as the above described color image forming apparatus, can realize a reliable cleaner system while simplifying the structure thereof.

Embodiment 4

Figure 11:
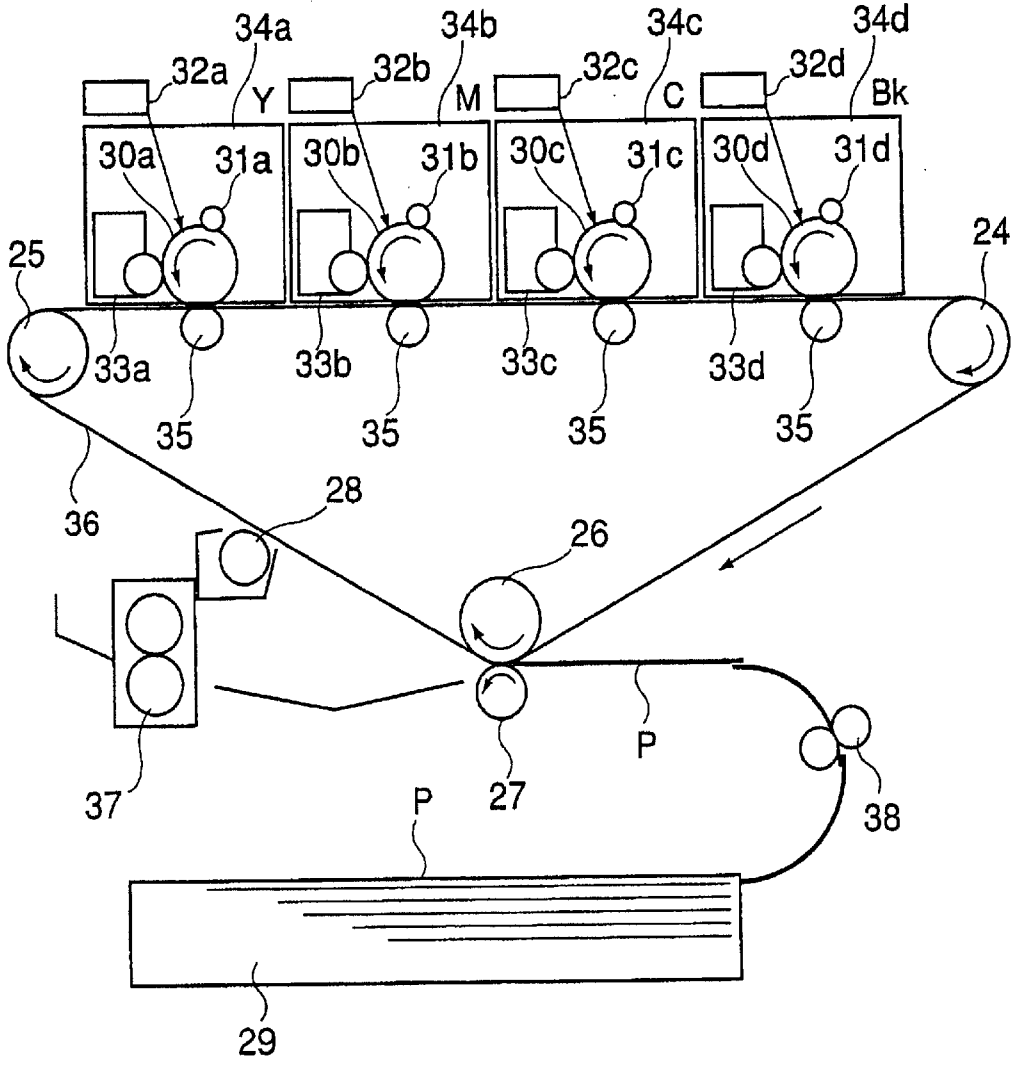
FIG. 11 is a rough sectional view of the image forming apparatus in the fourth embodiment of the present invention.

The forming apparatus in this embodiment is a full-color image forming apparatus employing an intermediary transfer belt as a transfer medium. FIG. 11 is a rough sectional view of the image forming apparatus, for showing the general structure thereof.

The referential codes Y, M, C, and Bk designate first to fourth image forming means for forming four images different in color, one-for-one. Since they are identical to the first to fourth image forming means in the third embodiment, their description will be omitted to avoid repetition.

Designated by a referential code 36 in an intermediary transfer belt, which is disposed so that it contacts all four photoconductive drums 30*a*–30*d* in the first to fourth image forming means Y, M, C, and Bk.

More specifically, the intermediary transfer belt 36 is disposed so that the nips formed between the intermediary transfer belt 36 and the photoconductive drums 30*a*–30*d* become no less than 0.5 mm in terms of the rotational direction of the belt, when primary transfer rollers 35, which will be described later, are not placed in contact with the intermediary transfer belt 36.

The intermediary transfer belt 36 is supported by three rollers, that is, a driver roller 24, a follower roller 35, and a secondary transfer roller 26, so that the intermediary transfer belt 36 is always provided with a proper amount of tension. As the driver roller 24 is driven, the intermediary transfer belt 36 moves in the direction from the photoconductive drum 30*a* to the photoconductive drum 30*d* at a virtually constant speed.

As the material for the intermediary transfer belt 36, resinous substance, for example, poly-vinylidene fluoride, poly-amide, poly-imide, poly-ethylene-terephthalate, polycarbonate, or the like, which is 50–300 $\mu$m in thickness, and $10^9$–$10^{16}$ ohm.cm is volumetric resistivity, or rubbery substance, for example, chloroprene rubber, ethylene-propylene-diene copolymer; rubbery substance, for example, NBR (nitrile butadiene rubber), urethane rubber, or the like, which is 0.5–2.0 mm in thickness, and $10^9$–$10^{16}$ ohm.cm in volumetric resistivity, is employed. In some cases, the volumetric resistivity of these materials are adjusted to $10^7$–$10^{11}$ ohm.cm by dispersing electrically conductive filler, for example, carbon, ZnO, $SnO_2$, $TiO_2$, or the like into the materials. Further, depending on the layout of the main assembly of an image forming apparatus, the intermediary transfer belt 36 may be supported by two rollers to simplify the structure, or an intermediary transfer drum, the surface layer of which is a functional layer, may be employed as an intermediary transfer member, instead of the intermediary transfer belt 36.

The primary transfer rollers 35 are placed in contact with the inward surface of the intermediary transfer belt 36, in a manner to correspond to the nips between the intermediary transfer belt 36 and the photoconductive drums 30*a*–30*d*. The details of the primary transfer rollers 35 will be described later.

During the primary transfer, that is, when transferring the toner images onto the intermediary transfer belt 36, a proper amount of positive DC bias is applied, independently to each of the primary transfer rollers 35.

An electrostatic latent image is formed on each of the photoconductive drums 1 by exposing the photoconductive drums 1 to the beams of light projected in response to the signals sent from a controller, with the provision of delay intervals in proportion to the distance between the adjacent two image transfer positions. The thus formed electrostatic latent images are developed into toner images different in color, and are sequentially transferred (primary transfer) onto the intermediary transfer belt 36 by the function of the primary transfer rollers 35. As a result, a multilayer image is formed on the intermediary transfer belt 36.

Thereafter, a bias which is reverse in polarity to the toner is applied to a secondary transfer roller 27 disposed in contact with the outward surface (image bearing surface) of the intermediary transfer belt 36 and in a manner to oppose the secondary transfer counter roller 26 disposed in contact with the inward surface of the intermediary transfer belt 36. Meanwhile, a recording paper P as a transfer medium, fed into the apparatus main assembly from a cassette 29 or a multi-feeder (unshown), in synchronism with the formation of the electrostatic latent images, is passed between the intermediary transfer belt 36 and secondary transfer roller 27. As the recording paper P is passed between the intermediary transfer belt 36 and secondary transfer roller 27, the four layers of the toner images different in color borne on the intermediary transfer belt 36 are transferred all at once (secondary transfer) onto the surface of the recording paper P.

As for the construction of the secondary transfer roller 27, a metallic core may be coated with an elastic material, for example, EPDM, urethane rubber, CR, NBR, or the like, the volumetric resistivity of which has been adjusted to $10^6$–$10^9$ ohm.cm.

The secondary transfer roller 27 is disposed so that it is pressed against the secondary transfer counter roller 26 with the interposition of the intermediary transfer belt 36 in a manner to generate a linear contact pressure of 5–15 g/cm, and so that it rotates in the same direction as the moving direction of the intermediary transfer belt 36 at a virtually constant speed.

The toner particles remaining on the surface of the intermediary transfer belt 36 after the secondary transfer, and the paper dust which is generated by the conveyance of the recording paper P, are removed and recovered by a belt cleaning means 28 disposed in contact with the intermediary transfer belt 36. In the image forming apparatus in this embodiment, a brush roller is employed as the belt cleaning means 28, and is disposed in contact with the surface of the intermediary transfer belt 36. However, an elastic cleaning blade or the like formed of urethane rubber or the like may be used as the belt cleaning means 28. Also, it is possible to place a cleaning blade and a brush roller on the upstream and downstream sides, respectively, in terms of the moving direction of the surface of the intermediary transfer belt 36 to improve the cleaning efficiency.

After the completion of the secondary transfer, the transfer medium is conveyed to a fixing means 37, in which the toner images are fixed to the recording medium. Thereafter, the recording medium is discharged as a print, or a copy, from the image forming apparatus main assembly.

Sometimes, the paper dust and the like fail to be completely removed from the intermediary transfer belt 36 by the belt cleaning means 28. If such paper dust and the like adhere to the photoconductive drum, an image which has a flowing appearance is sometimes formed.

As an image forming process progresses, a toner image recorded on a recording medium by an image forming means on the upstream side in terms of the flow of the image forming process, comes into contact with the photoconductive drum mounted in the image forming apparatus or image forming apparatuses on the downstream side. As a result, the toner used in an image forming apparatus on the upstream side sometimes adheres to the photoconductive drum mounted in an image forming means on the downstream side; in other words, so-called reverse transfer sometimes occurs.

If the toner from an image forming means on the upstream side is transferred onto the photoconductive drum of the image forming means on the downstream side, it is recovered by the developing device of the image forming means different in toner color from the upstream image forming means, and is recycled, which results in the formation of an image with a defect caused by the color mixture, or toner mixture. The more downstream in terms of the flow of an image forming process, the location of an image forming means, the more conspicuous the color mixture.

Thus, in this embodiment, in order to minimize the effect of the above described image defect, the image forming means are disposed in the order of Y—M—C—Bk.

Yellow toner is lower in luminosity (spectral luminous efficacy) than the other toners. Therefore, placing the image forming means for forming a yellow toner image on the most upstream side in term of the flow of the image forming process makes it difficult to recognize the above described image defect in a final image.

Thus, in the image forming apparatus in this embodiment, the image forming means for forming a yellow toner image is disposed on the most upstream side in terms of the flow of the image forming process so that if the above described image defect occurs, its effect upon a final image will be minimal.

As described above, in the image forming apparatus in this embodiment, which employs the intermediary transfer belt 36, the transfer efficiency with which a toner image is transferred from the peripheral surface of the photoconductive drum 1 onto the intermediary transfer medium, remains virtually constant regardless of the material, thickness, electrical resistance, and the like, of the recording paper P.

Further, a high transfer efficiency can be kept stable in various ambiances. Therefore, the amount of the transfer residual toner particles which remain on the peripheral surface of the photo-conductive drum 1 and are recovered by the developing means remains virtually constant, and also, the absolute amount of the transfer residual toner particles is smaller. Therefore, electrical charge is directly injected into the peripheral surface of the photoconductive drum 1, with high efficiency, and the toner recycling process in which the transfer residual toner particles are recovered by the developing device, is always carried out with high efficiency.

Since the secondary transfer residual toner particles which were not transferred onto the recording medium P are removed by the belt cleaning means, it is possible to prevent the paper dust from directly adhering to the photoconductive drums 30*a*–30*d*, moving into the charging means 31*a*–31*d*, and causing an image of inferior quality to be outputted.

As is evident from the merits described regarding the image forming apparatus in this embodiment, the image forming apparatus in this embodiment, which employs the intermediary transfer belt 36, is advantageous over an image forming apparatus which employs a recording medium conveying system based on an electrostatic conveying belt, in term of apparatus stability.

As described above, the image forming apparatus in this embodiment is a color image forming apparatus which comprises: a plurality of image bearing members; a plurality of charging means for charging the plurality of image bearing members one-for-one; a plurality of developing means for forming a plurality of toner images different in color by developing, with the use of a plurality of toners different in color, a plurality of electrostatic latent images formed on the charging peripheral surfaces of the plurality of image bearing members, one-for-one; and a plurality of transferring means for sequentially transferring the plurality of toner images different in color, onto transfer medium. It is characterized in that at least one of the plurality of charging means is a contact type charging apparatus which charges the peripheral surface of the image bearing member with the use of an elastic charging member which forms a contact nip against the image bearing member; that the charging member is porous at least across its surface which contacts the image bearing member, and is driven in a manner to maintain a predetermined amount of velocity difference relative to the image bearing member; that a combination of AC and DC voltages is applied to the charging member at least during an image recording period; and that the frequency f (cycle/set) of the AC voltage is set so that the following formula is satisfied:

$$|f/v| \geq 12 \text{ (cycle/mm)}$$

V: peripheral velocity of an image bearing member (mm/sec)

so that the phenomenon that as electrical charge is injected into the photoconductive drum 1 by the application of a combination of DC voltage and AC voltage, the peripheral surface of the photoconductive drum 1 becomes nonuniformly charged is suppressed.

Therefore, it is possible to prevent the image bearing member from being improperly charged by the accumulation of the toner particles, and also to prevent an image which suffers from the image defect called "elephant skin", from being formed. Thus, for a long period of time, the image forming apparatus in this embodiment can always form high quality color images.

<Miscellaneous>

1) The waveform of the AC component of charge bias or development bias is optional; it may be sinusoidal, rectangular, triangular, or the like. Further, the AC component may be an AC voltage with a rectangular waveform, formed by periodically turning on and off a DC power source. In other words, any voltage may be used as charge bias or development bias, as long as its waveform is such that its voltage value periodically fluctuates.

2) The selection of the image exposing means for forming an electrostatic latent image does not need to be limited to a laser beam based scanning type exposing means which forms a digital latent image as in the preceding embodiments. It may be an ordinary analog type image exposing means, or a light emitting element such as an LED. It may also be a combination of a light emitting element such as a fluorescent light or the like, and a liquid crystal shutter. In other words, any exposing means is usable as long as it is capable of forming an electrostatic latent image in accordance with image formation data.

3) The image bearing member may be an electrostatically recordable dielectric member or the like. In such a case, an intended electrostatic latent image is written by uniformly charging (primary charge) the peripheral surface of the dielectric member to a predetermined polarity, and then, selectively removing the electric charge of the peripheral surface of the dielectric member, with the use of an electric charge removing means, for example, an electric charge removing head, an electron gun, or the like.

4) Although in the descriptions of the preceding embodiments, the developing device 5 is described as a reversal type developing device which employed nonmagnetic single component toner, there is nothing to restrict developing device structure as far as the present invention is concerned. The present invention is also compatible with a normal type developing device.

Generally, the methods for developing an electrostatic latent image may be roughly classified into four groups: single component, noncontact type developing method group; single component, contact type developing method group; two component, contact type developing method group; and two component, noncontact type developing method group. In the single component, noncontact type developing method group, nonmagnetic toner, which is coated on a developer bearing/conveying member with the use of a blade or the like, or magnetic toner, which is coated on a developer bearing/conveying member with use of magnetic force, is selectively adhered to the peripheral surface of an image bearing member, without being placed in contact therewith, to develop an electrostatic latent image. In the single component, contact type developing method group, nonmagnetic toner or magnetic toner coated on a developer bearing/conveying member as in the single component, noncontact type developing method group, is placed in contact with the peripheral surface of an image bearing member to be selectively adhered thereto, to develop an electrostatic latent image. In the two component, contact type developing method group, developer is two component developer, that is, a mixture of toner particles and magnetic carrier, which is conveyed by magnetic force, is placed in contact with the peripheral surface of an image bearing member to be selectively adhered thereto, to develop an electrostatic latent image. In the two component, noncontact type developing method group, the above described two component developer is selectively adhered to the peripheral surface of an image bearing member, without being placed in contact therewith, to develop an electrostatic latent image.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

electrostatic image forming means for forming an electrostatic image on said image bearing member, said electrostatic image forming means including a flexible charge member for electrically charging said image bearing member, said charge member forming a nip between said image bearing member and itself and being supplied with an oscillating voltage, wherein electroconductive particles are provided in the nip and the electroconductive particles have an average particle size of 0.1–3 $\mu$m; and developing means for developing an electrostatic image formed on said image bearing member with a developer, said developing means being capable of removing residual developer on said image bearing member, wherein a frequency f (cycle/sec) of the oscillating voltage and peripheral speed v (mm/sec) of said image bearing member satisfy the following relationship:

$$|f/v| \geqq 12 \text{ (cycle/mm)}.$$

2. An apparatus according to claim 1, wherein a foam member is provided at a surface of said charge member.

3. An apparatus according to claim 1, wherein the oscillating voltage is applied when said charge member charges said image bearing member for image formation.

4. An apparatus according to claim 1, wherein the oscillating voltage has a peak-to-peak voltage, which is not less than 500V and is less than a voltage to which a potential level of said image bearing member converges.

5. An apparatus according to claim 1, wherein the oscillating voltage has a peak-to-peak voltage which is not less than 500V and preferably less than 1200V.

6. An apparatus according to claim 1, wherein the electroconductive particles have a resistance of not more than $10^{12}\Omega$ cm.

7. An apparatus according to claim 1, wherein said charge member is driven at a speed so as to have a peripheral speed difference relative to a speed of said image bearing member.

8. An apparatus according to claim 1, wherein a moving direction of said charge member is opposite from a moving direction of said image bearing member.

9. An apparatus according to claim 1, wherein said charge member comprises a roller.

10. An apparatus according to claim 1, wherein said image bearing member comprises a photosensitive member, and said electrostatic image forming means comprises exposure means for exposing said image bearing member charged by said charge member.

11. An apparatus according to claim 1, wherein said developing means comprises a developer carrying member for charging the developer, and said developer carrying member is contactable to said image bearing member.

12. An apparatus according to claim 1, wherein the developer has a shape factor SF-1 of 100–150 and a shape factor SF-2 of 100–140.

13. An apparatus according to claim 1, wherein said developing means is capable of collecting the residual developer from said image bearing member simultaneously with a developing operation.

14. An apparatus according to claim 1, further comprising transferring means for transferring a developed image from said image bearing member onto a transfer material.

15. An apparatus according to claim 1, wherein said apparatus comprises a plurality of image bearing members and transferring means for transferring developed images from said image bearing members to a transfer material.

16. An apparatus according to claim 14 or 15, wherein the transfer material is a sheet of paper or an intermediary transfer member.

17. An apparatus according to claim 15, wherein an image on one of said plurality of image bearing members on which the image is first developed, is developed with a developer having a lowest spectral luminous efficacy.

18. An apparatus according to claim 1, wherein said image bearing member and said charge member are provided in a process cartridge, which is detachably mountable on a main assembly of said apparatus.

19. An apparatus according to claim 1, wherein said charge member electrically charges said image bearing member through injection charging.

* * * * *

UNITED STATES PATENT AND TRADEMARK OFFICE

CERTIFICATE OF CORRECTION

PATENT NO. : 6,560,426 B2
DATED : May 6, 2003
INVENTOR(S) : Katsuhiro Sakaizawa et al.

It is certified that error appears in the above-identified patent and that said Letters Patent is hereby corrected as shown below:

Column 3,
Line 10, “charging means,” should read -- means,--.

Column 9,
Line 47, “different” should read -- difference --; and
Line 65, “and a” should read -- and at --.

Column 12,
Line 56, “embodiments,” should read -- embodiment, --.

Column 15,
Line 33, “f the” should read -- f of the --.

Column 16,
Line 57, “not” should read -- no --.

Column 20,
Line 5, “are use” should read -- use --.

Column 21,
Line 7, “contrast” should read -- a contact --.

Column 22,
Line 28, “because” should read -- became --.

Column 25,
Line 23, “result from” should read -- results from --.

Column 27,
Line 10, “roller,” should read -- roller. --;
Line 22, “The full-color toner” should be deleted; and
Line 23, “image on the recording paper P.” should be deleted.

UNITED STATES PATENT AND TRADEMARK OFFICE

CERTIFICATE OF CORRECTION

PATENT NO. : 6,560,426 B2
DATED : May 6, 2003
INVENTOR(S) : Katsuhiro Sakaizawa et al.

It is certified that error appears in the above-identified patent and that said Letters Patent is hereby corrected as shown below:

Column 29,
Line 58, “term” should read -- terms --.

Column 30,
Line 30, “term” should read -- terms --.

Signed and Sealed this

Twenty-third Day of March, 2004

JON W. DUDAS
*Acting Director of the United States Patent and Trademark Office*